US008774666B2

(12) United States Patent
Saito et al.

(10) Patent No.: US 8,774,666 B2
(45) Date of Patent: Jul. 8, 2014

(54) FIXING DEVICE AND IMAGE FORMING APPARATUS INCORPORATING SAME

(71) Applicants: Kazuya Saito, Kanagawa (JP); Takeshi Uchitani, Kanagawa (JP); Takamasa Hase, Shizuoka (JP); Shuutaroh Yuasa, Kanagawa (JP); Ippei Fujimoto, Kanagawa (JP); Shinichi Namekata, Kanagawa (JP); Ryota Yamashina, Kanagawa (JP); Hiroshi Seo, Kanagawa (JP); Takumi Waida, Tokyo (JP)

(72) Inventors: Kazuya Saito, Kanagawa (JP); Takeshi Uchitani, Kanagawa (JP); Takamasa Hase, Shizuoka (JP); Shuutaroh Yuasa, Kanagawa (JP); Ippei Fujimoto, Kanagawa (JP); Shinichi Namekata, Kanagawa (JP); Ryota Yamashina, Kanagawa (JP); Hiroshi Seo, Kanagawa (JP); Takumi Waida, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 14 days.

(21) Appl. No.: 13/716,651

(22) Filed: Dec. 17, 2012

(65) Prior Publication Data

US 2013/0209124 A1 Aug. 15, 2013

(30) Foreign Application Priority Data

Feb. 9, 2012 (JP) ..... 2012-026635

(51) Int. Cl.
*G03G 15/20* (2006.01)

(52) U.S. Cl.
CPC ..... *G03G 15/2078* (2013.01); *G03G 15/2082* (2013.01)
USPC ..... 399/69; 399/334

(58) Field of Classification Search
CPC ..... G03G 15/2078; G03G 15/2064; G03G 15/2082
USPC ..... 399/69, 70, 334; 219/216
See application file for complete search history.

(56) References Cited

U.S. PATENT DOCUMENTS

| | | | | |
|---|---|---|---|---|
| 7,333,743 | B2 * | 2/2008 | Kishi et al. | 399/69 |
| 8,019,247 | B2 * | 9/2011 | Mito et al. | 399/69 |
| 2006/0177232 | A1 | 8/2006 | Ehara et al. | |
| 2007/0003334 | A1 | 1/2007 | Shinshi et al. | |
| 2007/0059003 | A1 | 3/2007 | Shinshi et al. | |

(Continued)

FOREIGN PATENT DOCUMENTS

| | | |
|---|---|---|
| JP | 2007-233011 | 9/2007 |
| JP | 2011-164264 | 8/2011 |

OTHER PUBLICATIONS

U.S. Appl. No. 13/577,841, filed Jul. 25, 2012, Toshihiko Shimokawa, et al.

(Continued)

*Primary Examiner* — Hoang Ngo
(74) *Attorney, Agent, or Firm* — Oblon, Spivak, McClelland, Maier & Neustadt, L.L.P.

(57) ABSTRACT

A fixing device includes a heating device to heat an endless rotary body with radiant heat, a power source to supply power to the heating device, a first heat source to heat a region on the endless rotary body corresponding to a width of the small size sheet, and a second heat source to heat regions on the endless rotary body corresponding to both widthwise ends of the large size sheet outside the width of the small size sheet. The power source supplies power only to the first heat source when the small size sheet is printed and to both the first and second heat sources when the large size sheet is printed. The power source supplies more power to the first heat source when the small size sheet is printed than when the large size sheet is printed within a maximum power available to the fixing device.

13 Claims, 6 Drawing Sheets

(56) References Cited

U.S. PATENT DOCUMENTS

| | | | |
|---|---|---|---|
| 2007/0059011 | A1 | 3/2007 | Seo et al. |
| 2007/0212089 | A1 | 9/2007 | Seo et al. |
| 2007/0280754 | A1 | 12/2007 | Ogawa et al. |
| 2007/0286628 | A1 | 12/2007 | Kayahara et al. |
| 2008/0044196 | A1 | 2/2008 | Seo et al. |
| 2008/0253789 | A1 | 10/2008 | Yoshinaga et al. |
| 2009/0003867 | A1 | 1/2009 | Fujimoto |
| 2009/0169232 | A1 | 7/2009 | Kunii et al. |
| 2009/0297197 | A1 | 12/2009 | Hase |
| 2009/0297199 | A1 | 12/2009 | Yamashina et al. |
| 2010/0061753 | A1 | 3/2010 | Hase |
| 2010/0061754 | A1 | 3/2010 | Ishigaya et al. |
| 2010/0092220 | A1 | 4/2010 | Hasegawa et al. |
| 2010/0092221 | A1 | 4/2010 | Shinshi et al. |
| 2010/0290822 | A1 | 11/2010 | Hasegawa et al. |
| 2011/0026988 | A1 | 2/2011 | Yoshikawa et al. |
| 2011/0044734 | A1 | 2/2011 | Shimokawa et al. |
| 2011/0052224 | A1 | 3/2011 | Yamashina et al. |
| 2011/0052237 | A1 | 3/2011 | Yoshikawa et al. |
| 2011/0052282 | A1 | 3/2011 | Shinshi et al. |
| 2011/0058862 | A1 | 3/2011 | Yamaguchi et al. |
| 2011/0058863 | A1 | 3/2011 | Shinshi et al. |
| 2011/0058864 | A1 | 3/2011 | Fujimoto et al. |
| 2011/0058865 | A1 | 3/2011 | Tokuda et al. |
| 2011/0058866 | A1 | 3/2011 | Ishii et al. |
| 2011/0064437 | A1 | 3/2011 | Yamashina et al. |
| 2011/0064443 | A1 | 3/2011 | Iwaya et al. |
| 2011/0064450 | A1 | 3/2011 | Ishii et al. |
| 2011/0064490 | A1 | 3/2011 | Imada et al. |
| 2011/0076071 | A1 | 3/2011 | Yamaguchi et al. |
| 2011/0085832 | A1 | 4/2011 | Hasegawa et al. |
| 2011/0091226 | A1 | 4/2011 | Ishigaya et al. |
| 2011/0116848 | A1 | 5/2011 | Yamaguchi et al. |
| 2011/0129268 | A1 | 6/2011 | Ishii et al. |
| 2011/0150518 | A1 | 6/2011 | Hase et al. |
| 2011/0170917 | A1 | 7/2011 | Yoshikawa et al. |
| 2011/0182634 | A1 | 7/2011 | Ishigaya et al. |
| 2011/0182638 | A1 | 7/2011 | Ishii et al. |
| 2011/0194869 | A1 | 8/2011 | Yoshinaga et al. |
| 2011/0194870 | A1 | 8/2011 | Hase et al. |
| 2011/0200368 | A1 | 8/2011 | Yamaguchi et al. |
| 2011/0200370 | A1 | 8/2011 | Ikebuchi et al. |
| 2011/0206402 | A1 | 8/2011 | Yamashina |
| 2011/0206427 | A1 | 8/2011 | Iwaya et al. |
| 2011/0217056 | A1 | 9/2011 | Yoshinaga et al. |
| 2011/0217057 | A1 | 9/2011 | Yoshinaga et al. |
| 2011/0217093 | A1 | 9/2011 | Tokuda et al. |
| 2011/0217095 | A1 | 9/2011 | Ishii et al. |
| 2011/0222875 | A1 | 9/2011 | Imada et al. |
| 2011/0222876 | A1 | 9/2011 | Yuasa et al. |
| 2011/0222888 | A1 | 9/2011 | Ikebuchi et al. |
| 2011/0222927 | A1 | 9/2011 | Yamashina |
| 2011/0222929 | A1 | 9/2011 | Fujimoto et al. |
| 2011/0222930 | A1 | 9/2011 | Fujimoto et al. |
| 2011/0222931 | A1 | 9/2011 | Shinshi et al. |
| 2011/0229161 | A1 | 9/2011 | Ueno et al. |
| 2011/0229180 | A1 | 9/2011 | Saito |
| 2011/0229181 | A1 | 9/2011 | Iwaya et al. |
| 2011/0229200 | A1 | 9/2011 | Yamaguchi et al. |
| 2011/0229225 | A1 | 9/2011 | Ishii et al. |
| 2011/0229226 | A1 | 9/2011 | Tokuda et al. |
| 2011/0229227 | A1 | 9/2011 | Yoshikawa et al. |
| 2011/0229228 | A1 | 9/2011 | Yoshikawa et al. |
| 2011/0274453 | A1 | 11/2011 | Shimokawa et al. |
| 2011/0293309 | A1 | 12/2011 | Hase |
| 2011/0311284 | A1 | 12/2011 | Seo et al. |
| 2012/0045226 | A1 | 2/2012 | Hase et al. |
| 2012/0051766 | A1 | 3/2012 | Ueno et al. |
| 2012/0051774 | A1 | 3/2012 | Ikebuchi et al. |
| 2012/0093531 | A1 | 4/2012 | Yuasa et al. |
| 2012/0093532 | A1 | 4/2012 | Ishigaya et al. |
| 2012/0093534 | A1 | 4/2012 | Waida et al. |
| 2012/0093551 | A1 | 4/2012 | Ogawa et al. |
| 2012/0107005 | A1 | 5/2012 | Hase et al. |
| 2012/0114345 | A1 | 5/2012 | Fujimoto et al. |
| 2012/0114354 | A1 | 5/2012 | Saito et al. |
| 2012/0121303 | A1 | 5/2012 | Takagi et al. |
| 2012/0121304 | A1 | 5/2012 | Tokuda et al. |
| 2012/0121305 | A1 | 5/2012 | Yoshikawa et al. |
| 2012/0148303 | A1 | 6/2012 | Yamaguchi et al. |
| 2012/0155935 | A1 | 6/2012 | Yoshikawa et al. |
| 2012/0155936 | A1 | 6/2012 | Yamaguchi et al. |
| 2012/0177388 | A1 | 7/2012 | Imada et al. |
| 2012/0177393 | A1 | 7/2012 | Ikebuchi et al. |
| 2012/0177420 | A1 | 7/2012 | Shimokawa et al. |
| 2012/0177423 | A1 | 7/2012 | Imada et al. |
| 2012/0177424 | A1 | 7/2012 | Saito et al. |
| 2012/0201547 | A1 | 8/2012 | Yamashina |
| 2012/0207502 | A1 | 8/2012 | Seo |
| 2012/0207523 | A1 | 8/2012 | Ueno et al. |
| 2012/0219312 | A1 | 8/2012 | Yuasa et al. |
| 2012/0224878 | A1 | 9/2012 | Ikebuchi et al. |
| 2012/0237273 | A1 | 9/2012 | Yoshinaga et al. |
| 2012/0243895 | A1 | 9/2012 | Samei et al. |
| 2012/0301161 | A1 | 11/2012 | Fujimoto |

OTHER PUBLICATIONS

U.S. Appl. No. 13/608,128, filed Sep. 10, 2012, Shuutaroh Yuasa, et al.

* cited by examiner

FIXING DEVICE AND IMAGE FORMING APPARATUS INCORPORATING SAME

CROSS-REFERENCE TO RELATED APPLICATION

This patent application is based on and claims priority pursuant to 35 U.S.C. §119 to Japanese Patent Application No. 2012-026635, filed on Feb. 9, 2012, in the Japan Patent Office, the entire disclosure of which is hereby incorporated by reference herein.

BACKGROUND OF THE INVENTION

1. Field of the Invention

The present invention relates to a fixing device and an image forming apparatus, such as a copier, a printer, a facsimile machine, a multifunctional device, etc., with the fixing device.

2. Description of the Related Art

As used in various types of image forming apparatuses, a fixing device of a thin fixing belt type consisting of an elastic rubber layer and a metal substrate or the like is known. In such a system, due to the low-heat capacity of the thin fixing belt, the energy needed in heating the fixing belt is significantly reduced and a warm-up time period from when power source is turned on, for example, to when room temperature is increased to a prescribed printable level (i.e., a reload temperature level) can be shortened. Further, a time to first print (i.e., a time period from receiving a printing request to completing sheet ejection through preparing and conducting the printing) is shortened as well.

In a conventional fixing apparatus as described in Japanese Patent Application Publication No. 2007-233011 (JP-2007-233011-A), a nip is formed by a pressing roller, an endless belt as a hollow endless rotary body, a pressing roller in contact with an outer surface of the endless belt, and a nip formation member placed inside the endless belt, with the nip formation member and the pressing roller sandwiching the endless belt. On an inner circumferential side of the endless belt, there is provided a single heat source as a heating device for heating the entire width of the endless belt with radiant heat. Since the endless belt can be directly heated by the radiant heat from the heat source at places other than that of the position of the nip formation member, efficiency of heat transfer from the heat source to the endless belt is widely improved. As a result, power consumption and the above-described time to first print can be further reduced.

In such a conventional system, in a sheet passage region on the endless belt over which the sheet passes, heat is deprived therefrom by the sheet contacting the endless belt as described in JP-2007-233011-A. Specifically, when since heat capacity of the endless belt is relatively small, heat transferred to the endless belt is deprived by a sheet, and accordingly the temperature of the endless belt drops significantly in the sheet passage region in the conventional fixing apparatus. Therefore, when sheets are continuously fed, defective fixing occurs unless the sheet passage region on the endless belt is heated by the heat source up to a prescribed fixing temperature capable of maintaining an appropriate fixing condition.

Further, in a fixing device installed in an image forming apparatus that is capable of feeding relatively small- and large-sized sheets and obtaining higher productivity of the small-sized sheet, an endless belt more likely loses and cannot obtain sufficient heat from a heat source when the small size sheet is fed and printed than the large size sheet. Therefore, the sheet passage region of the endless belt becomes unable to maintain a prescribed fixing temperature resulting in defective fixing when the small-sized sheets are continuously fed and printed.

To resolve such a problem, conceivably, power supplied to the heater to heat 1 the endless belt when the small-sized sheet is printed can be increased beyond what is supplied when the large-sized sheet is printed. However, in general, the amount of power available to the fixing device is limited depending on the power consumed by the other devices in an image forming apparatus to keep the total power consumption within certain limits. Thus, if power to be supplied to the heat source is simply increased to execute printing of the small-sized sheet, power supplied to the heat source likely reaches the maximum level available to the fixing device before the sheet passage region of the endless belt is heated up to the prescribed fixing temperature. As a result, the heat source is unable to receive enough power, and consequently the fixing device falls into lack of power. Consequently, the heat source can no longer heat the sheet passage region of the endless belt up to the prescribed fixing temperature.

SUMMARY OF THE INVENTION

Accordingly, the present invention provides a novel fixing device that conveys small and large size sheets and includes a hollow endless rotary body, a pressing member to contact an outer circumferential surface of the endless rotary body, and a nip forming member placed on an inner circumferential side of the endless rotary body to contact the pressing member via the endless rotary body and form a nip thereon. A heating device is placed on the inner circumferential side of the endless rotary body to heat the endless rotary body with radiant heat. A power source is provided to supply power to the heating device. The heating device includes a first heat source to heat a region on the endless rotary body corresponding to a width of the small size sheet and a second heat source to heat regions on the endless rotary body corresponding to both widthwise ends of the larger size sheet outside the width of the small size sheet. Further, the power source supplies power only to the first heat source when the small size sheet is printed and to both the first and second heat sources when the large size sheet is printed. Further, the power source supplies more power to the first heat source when the small size sheet is printed than when the large size sheet is printed within a maximum power available to the fixing device.

In another aspect of the present invention, the power source supplies power to the first heat source with a lighting rate of 100% when the small size sheet is printed. The lighting rate is a percentage of lighting the heat source per unit time.

In yet another aspect of the present invention, a first shielding member is provided to shield the endless rotary body from radiation heat emitted from the first and second heat sources, and the shielding member is arranged between the endless rotary body and both widthwise ends of the first and second heat sources.

In yet another aspect of the present invention, a third heat source is provided to heat a region of the endless rotary body corresponding to both ends and outer sides of the large size sheet (in the widthwise direction), and a second shielding member is provided to shield the endless rotary body from radiation heat emitted from the second and third heat sources. The second shielding member is arranged between the endless rotary body and both widthwise end of the second and third heat sources.

In yet another aspect of the present invention, the respective first to third heat sources serve as vertexes collectively forming almost a triangle when viewed in a widthwise direction of the endless rotary body, and the third heat source is located closer to the nip formation member than the first and second heat sources.

In yet another aspect of the present invention, the power source device supplies power only to the first and third heat sources, and the power supplied to the third heat source is greater than that supplied to the first heat source when a sheet having a greater width than the large size sheet is printed.

In yet another aspect of the present invention, an image forming apparatus includes an image carrier, a latent image formation device to form a latent image on the image carrier, a developing device to form a toner image by developing the latent image with toner, a transfer device to transfer the toner image from the image carrier onto a sheet, and the above-described fixing device fixing the toner image transferred onto the sheet.

BRIEF DESCRIPTION OF THE SEVERAL VIEWS OF THE DRAWINGS

A more complete appreciation of the present invention and many of the attendant advantages thereof will be more readily obtained as substantially the same becomes better understood by reference to the following detailed description when considered in connection with the accompanying drawings, wherein.

DETAILED DESCRIPTION OF THE INVENTION

Figure 1:
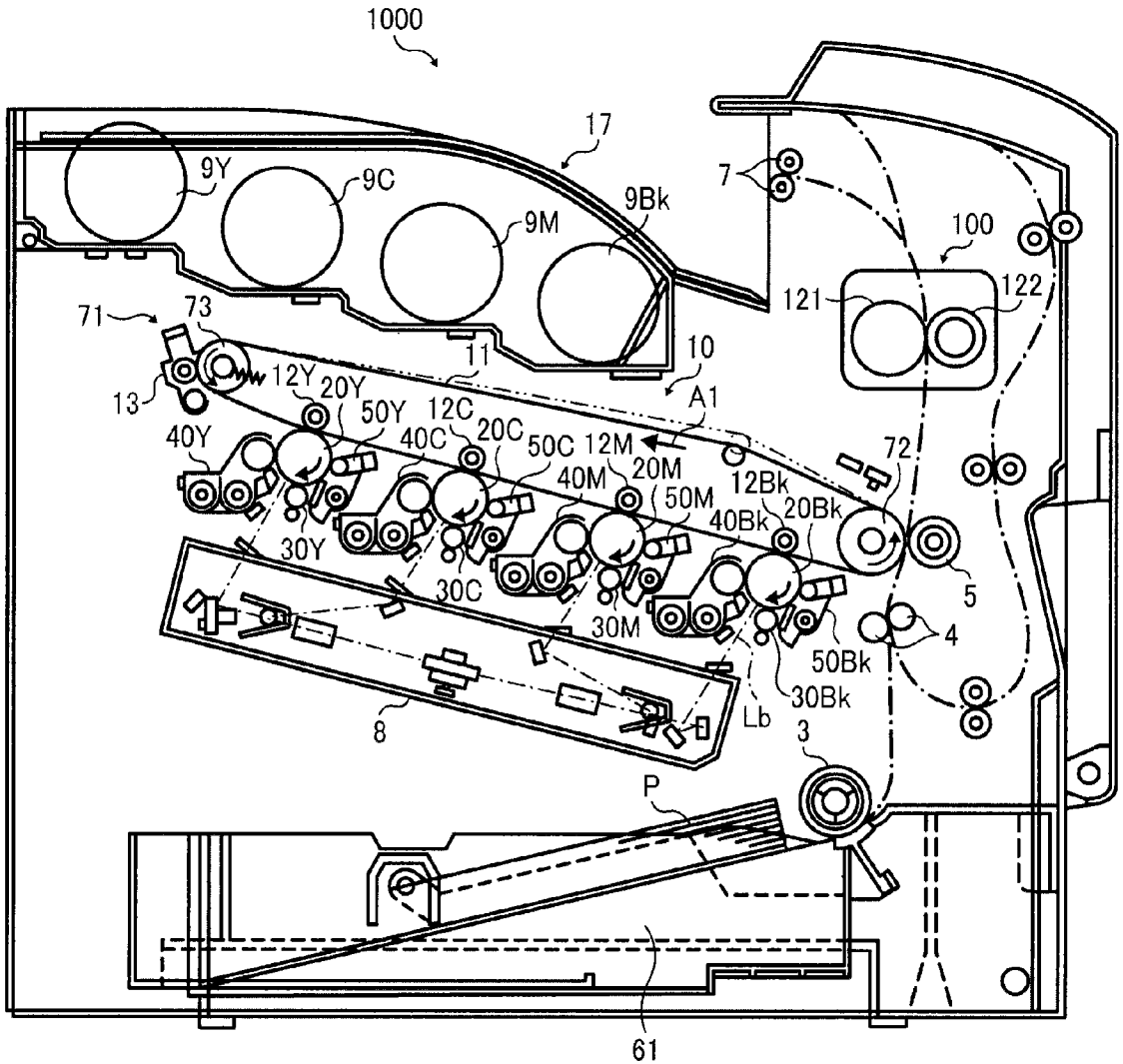
FIG. 1 is a schematic block diagram showing one example of an overall image formation apparatus according to one embodiment of the present invention.

Referring now to the drawings, wherein like reference numerals designate identical or corresponding parts throughout the several views thereof and in particular to FIG. 1, an overall configuration of an image forming apparatus according to one embodiment of the present invention is initially described. The image forming apparatus shown in FIG. 1 is a color laser printer of a tandem type and is provided with an image station at a center of its body, which consists of four image formation units to form multiple color images. The multiple image formation units are arranged side by side in a stretching direction of an intermediate transfer belt as an endless belt transfer member (hereinafter referred to as a "transfer belt"). The multiple image forming units have the similar configuration with each other except for accommodated developer colors of yellow (Y), magenta (M), cyan (C), and black (Bk) corresponding to resolution components of a color image, respectively.

As shown in FIG. 1, the image forming apparatus 1000 includes multiple photoconductive drums 20Y, 20C, 20M, and 20Bk disposed side by side as image carriers corresponding to respectively separated colors of yellow, cyan, magenta, and black. A color toner image formed on each of the photoreceptor drums 20Y, 20C, 20M, and 20Bk as a visualized image is transferred onto a transfer belt 11, which is movable in a direction as shown by arrow A1 facing the each of the photoconductive drums 20Y, 20C, 20M, and 20Bk, during a primary transfer process. Each of the color toner images is then transferred and superimposed on the transfer belt 11. The toner image transferred and superimposed on the transfer belt 11 is then further transferred onto a sheet P as a recording medium at once during a secondary transfer process.

Around each of the photoconductive drums 20Y, 20C, 20M, and 20Bk, various devices are disposed to execute image formation processing as the photoconductive drum 20 rotates. Now, only the photoreceptor drum 20Bk executing black image formation is typically explained. There are provided, around the photoconductive drum 20Bk, a charging device 30Bk, a developing 40Bk, a primary transfer roller 12Bk as a primary transfer device, and a cleaning device 50Bk in a rotational direction of the photoreceptor drum 20Bk to execute an image formation process. To write an electrostatic latent image on the photoreceptor drum 20Bk after a charge process therefor, an optical writing system 8 as a device of exposing a surface of the photoconductive drum 20Bk is used.

The optical writing system 8 includes a semiconductor laser as a light source, a coupling lens, an fθ lens, a toroidal lens, a reflecting mirror, and a rotating polygonal mirror (a polygon mirror) as a light deflection device or the like. The optical writing system 8 irradiates optical writing light Lb (e.g., a laser light) and forms an electrostatic latent image on each of the surfaces of the photoconductive drums 20Y, 20C, 20M, and 20Bk.

When the transfer belt 11 moves in a direction A1 in the drawing, a visible image (i.e., a toner image) formed on each of the photoreceptor drums 20Y, 20C, 20M, and 20Bk is transferred onto substantially the same position of the transfer belt 11. Specifically, a primary transfer bias is applied to each of the multiple primary transfer rollers 12Y, 12C, 12M, and 12Bk facing the photoconductive drums 20Y, 20C, 20M, and 20Bk across the transfer belt 11, respectively. Thus, the visible image (i.e., the toner image) formed on each of the photoconductive drums 20Y, 20C, 20M, and 20Bk is transferred and superimposed by each of the primary transfer rollers 12Y, 12C, 12M, and 12Bk provided with the primary transfer bias at different times from upstream to downstream sides in the direction A1 of the transfer belt 11.

The multiple primary transfer rollers 12Y, 12C, 12M, and 12Bk collectively hold the transfer belt 11 together with the photoconductive drums 20Y, 20C, 20M, and 20Bk, respectively, thereby forming primary transfer nips therebetween. Further, a power source, not shown, is connected to each of the primary transcript rollers 12Y, 12C, 12M, and 12Bk, so that a primary transfer bias consisting of a given direct current voltage (DC) and/or an alternating current (AC) can be applied to each of those.

The photoconductive drums 20Y, 20C, 20M, and 20Bk line up in this order from the upstream side in the direction A1 in the drawing. Each of the photoconductive drums 20Y, 20C, 20M, and 20Bk is provided in each of multiple image formation units forming each of images of the yellow, cyan, magenta, and black, respectively.

Further, in addition to the multiple image formation units, the image forming apparatus 1000 includes a transfer belt unit (i.e., a transfer device) disposed above the photoconductive drums 20Y, 20C, 20M, and 20Bk, a secondary transfer roller 5 serving as a secondary transfer device, a transfer belt cleaning unit 13, and an optical writing system 8 disposed below the multiple image formation units.

The transfer belt unit 10 includes the above-described endless transfer belt 11 and multiple belt support members, such as the multiple primary transfer rollers 12Y, 12C, 12M, and 12Bk, and driven rollers 72 and 73 each stretching the transfer belt 11, etc. Specifically, the transfer belt 11 laps and runs (i.e., circulates) in the direction A1 as shown in the drawing when the driven roller 72 is driven and rotates. The driven roller 72 serves as a secondary transfer backup roller opposed to the secondary transfer roller 5 via the transfer belt 11. The driven roller 73 serves as a cleaning backup roller opposed to the transfer belt cleaning device 13 via the transfer belt 11. Since it also serves as a tension applying device applying a tension to the transfer belt 11, the driven roller 73 is provided with a bias device, such as a spring, etc. Hence, the transfer device 71 includes these primary transfer rollers 12Y, 12C, 12M, and 12Bk, the transfer belt unit 10, the secondary transfer roller 5, and the transfer belt cleaning device 13.

The secondary transfer roller 5 is located opposite it and is accordingly driven by the transfer belt 11. The secondary transfer roller 5 also holds the transfer belt 11 and forms a secondary transfer nip together with the driving roller 72 serving as the secondary transfer backup roller therebetween. Similar to the above-described primary transfer rollers 12Y, 12C, 12M, and 12Bk, a power source, not shown, is connected to the secondary transfer roller 5, so that the secondary transfer bias composed of a given direct current voltage (DC) and/or an alternating current (AC) can be applied to those as well.

The transfer belt cleaning device 13 is disposed opposite the driven roller 73 through the transfer belt 11 and cleans the surface of the transfer belt 11. In this example, the transfer belt cleaning unit 13 includes a cleaning brush and a cleaning blade each contacting the transfer belt 11. Further, a waste toner transfer hose, not shown, is provided extending from the transfer belt cleaning device 13, and is connected to an entrance of a waste toner container, not shown.

Further, the image forming apparatus 1000 is provided with a recording medium supplying cassette (i.e., a sheet feeder) 61 as a recording medium container storing a sheet P as a recording medium, a pair of registration rollers 4 as a recording medium advancing device, and a sheet end sensor as a detection device detecting a leading end of the recording medium. The sheet cassette 61 is disposed at the bottom of the body of the image forming apparatus 1000 and includes a sheet supply roller 3 as a recording medium supply device that contacts a surface of the uppermost sheet P. Thus, when the sheet feed roller 3 is driven and rotates counterclockwise in the drawing, the topmost sheet P is fed toward the pair of registration rollers 4.

In addition, a sheet transportation path is disposed inside the printer body to convey the sheet P from the sheet cassette 61 and emits the sheet P outside the device passing through the secondary transfer nip. On the upstream side of the secondary transfer roller 5 in the sheet transport direction on the sheet transportation path, the pair of registration rollers 4 is provided to convey the sheet P to the secondary transfer section (i.e., a secondary transfer nip). The pair of registration rollers 4 feed the sheet P transported from the sheet cassette 61 toward the secondary transfer section (i.e., the secondary transfer nip) formed between the secondary transfer roller 5 and the transfer belt 11 at a given time to synchronize with formation of a toner image in the image formation station which mainly consists of the above-described multiple image formation sections. The sheet end sensor detects an effect that a tip of the sheet P reaches the pair of registration rollers 4.

The sheet P as a recording medium includes a cardboard, a postcard, an envelope, a shin sheet, a coated sheet (e.g., a coated sheet, an art sheet, etc.), a tracing sheet, and an OHP sheet in addition to a plain sheet P. Further, in addition to the sheet feed tray 61, a manual sheet feed mechanism may be provided to enable manual insertion of a sheet P.

The image forming apparatus 1000 is also provided with a fixing device 100 as a fixing device for fixing a transferred toner image onto a sheet P, a sheet exit roller 7 as a device of ejecting a recording medium, a sheet exit tray 17 as a device of stacking a recording medium, and multiple toner bottles 9Y, 9C, 9M, and 9Bk as toner cartridges. The sheet exit roller 7 ejects the sheet P having been subjected to the fixing process outside the body of the image forming apparatus 1000. The sheet exit tray 17 is provided on a top of the image forming apparatus 1000 to load sheets P discharged outside the body thereof by the sheet exit roller 7.

The multiple toner bottles 9Y, 9C, 9M, and 9Bk are filled with yellow, cyan, magenta, and black color toner particles, respectively, and are detachably attached to multiple bottle containers provided on the top of the printer body below the sheet exit tray 17. Further, a supply path, not shown, is provided between each of the toner bottles 9Y, 9C, 9M, and 9Bk and each of the developing devices 40Y, 40C, 40M, and 40Bk. Thus, toner is supplied from respective toner bottles 9Y, 9C, 9M, and 9Bk to the corresponding developing devices 40Y, 40C, 40M, and 40Bk via the supply lines.

It is not illustrated in detail, but the transfer belt cleaning device 13 installed in the transfer unit 71 includes a cleaning blade and a cleaning brush each facing and almost contacting the transfer belt 11. With these cleaning brush and cleaning blade, foreign material, such as residual toner, etc., remaining on the transfer belt 11 can be removed cleaning the transfer belt 11. The transfer belt cleaning device 13 has a discharge device, not shown, to convey and dispose of the residual toner removed from the transfer belt 11.

Now, a basic operation of the image forming apparatus 1000 with the above-described configuration is described. When image formation operation starts in the image forming apparatus 1000, each of the photoconductive drums 20Y, 20C, 20M, and 20Bk provided in each of the image formation sections is driven and rotates clockwise by a driving device, not shown, in the drawing, so that a surface of each of the photoconductive drums 20Y, 20C, 20M, and 20Bk is uniformly charged by each of the discharging devices 30Y, 30C, 30M, and 30Bk in a designated polarity. Each of the laser beams is irradiated from the optical writing device 8 to each of the thus charged surfaces of the photoconductive drums 20Y, 20M, 20C, and 20Bk so that an electrostatic latent image is formed on each of the photoconductive drums 20Y, 20C, 20M, and 20Bk. Here, image information to provide exposure to each of the photoconductive drums 20Y, 20C, 20M, and 20Bk is obtained by separating a prescribed full-color image into respective monochromatic color image information data of yellow, magenta, cyan, and black. Hence, toner is supplied to the latent image formed on each of the photoconductive drums 20Y, 20C, 20M, and 20Bk by each of the development devices 40Y, 40C, 40M, and 40Bk, so that the electrostatic latent image is visualized as a toner image (i.e., image visualization).

Further, when the image formation operation starts, the driving roller (i.e., the secondary transfer backup roller) 72 is driven and rotates counterclockwise, and circulates the transfer belt 11 in a direction as shown by arrow A1 in FIG. 1. Further, each of the primary transfer rollers 12Y, 12C, 12M, and 12Bk is provided with a voltage subjected to constant current or voltage control having a reverse polarity to that of usage toner. This allows a primary transfer nip formed between each of the primary transcript rollers 12Y, 12C, 12M, and 12Bk and each of the photoconductive drums 20Y, 20C, 20M, and 20Bk, respectively, to form a prescribed transfer electric field.

Subsequently, as each of the photoconductive drums 20Y, 20C, 20M, and 20Bk rotates, each of the toner images thereon is transferred and superimposed on the transfer belt 11 one by one under the transfer field formed in the above-described transfer nip, when a color toner image on each of the photoconductive drums 20Y, 20C, 20M, and 20Bk reaches each of the primary transfer nips. Hence, the full-color toner image is carried on the surface of the transfer belt 11. Further, the toner on each of the photoconductive drums 20Y, 20C, 20M, and 20Bk not completely transferred onto the transfer belt 11 is removed by each of the cleaning devices 50Y, 50C, 50M, 50Bk. After that, residual charge on the surface of each of the photoconductive drums 20Y, 20C, 20M, and 20Bk is eliminated by a charge eliminator, not shown, initializing the surface potential.

At the bottom of the image forming apparatus 1000, the feed roller 3 starts rotary driving so that a sheet P is sent to the transportation path from the sheet cassette 61. The sheet P sent via the transportation path is fed by the pair of registration rollers 4 at a prescribed timing to a secondary transfer nip formed between the secondary transfer roller 5 and the driving roller (i.e., the secondary transfer backup roller) 72. At this moment, to the secondary transfer roller 5, a transfer voltage in a reverse polarity to a polarity of charged toner in a toner image borne on the transfer belt 11 is applied. Thus, a given transfer electric field is created in the secondary transfer nip.

Subsequently, when the toner image on the transfer belt 11 reaches the secondary transfer nip as the transfer belt 11 runs and circulates, the toner image on the transfer belt 11 is transferred onto the sheet P at once under the transfer field created in the above-described secondary transfer nip. Residual toner on the transfer belt 1 not completely transferred onto the sheet P at this moment is then removed by the transfer belt cleaning unit 13, and the thus removed toner is further transferred to a waste toner container, not shown, and is collected.

Subsequently, the sheet P is conveyed to the fixing device 100, and the toner image on the sheet P is fused thereon by the fixing device 100. The sheet P is then ejected by the exit roller 7 outside the apparatus and is stocked on the exit tray 17.

The above-described image formation is executed when forming a full-color image on a sheet P. However, a monochrome image can be formed using one of the four image forming units. A dual or triple color image can also be formed using two or three image formation units, respectively.

Now, a fixing device 100 with the above-described configuration used in the image forming apparatus 1000 is more concretely described.

Figure 2:
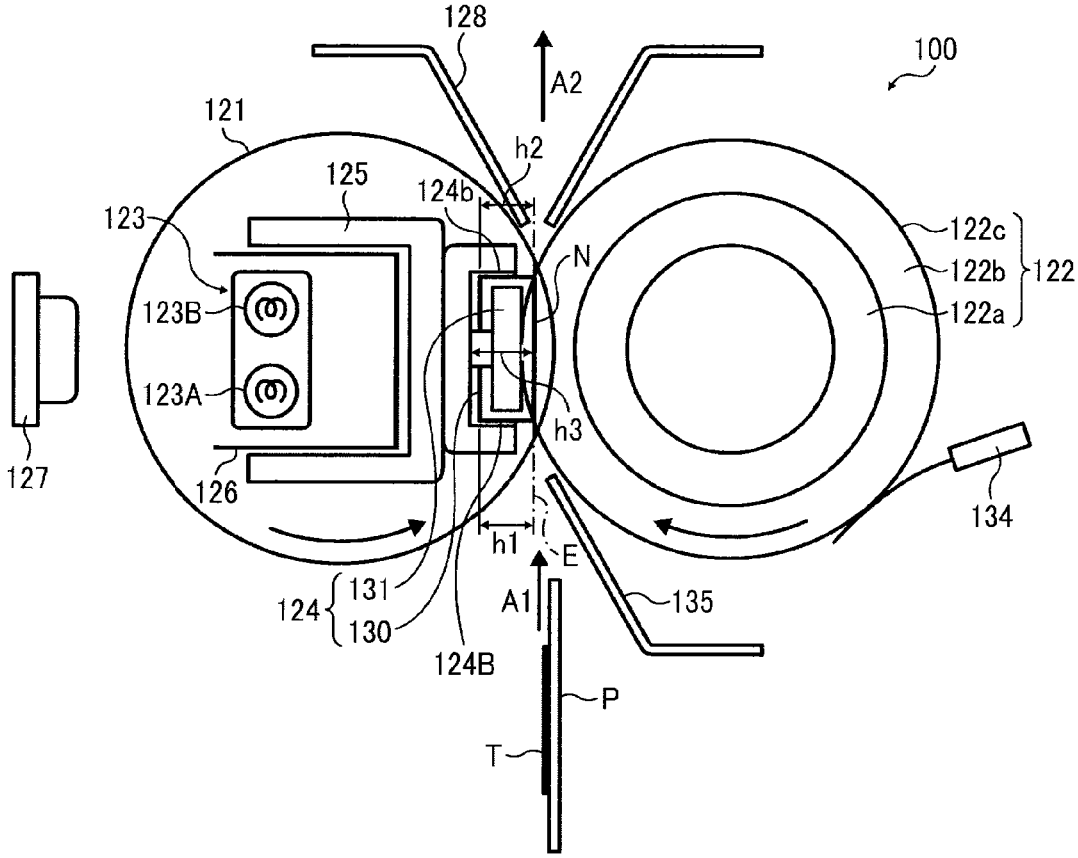
FIG. 2 is a schematic block diagram showing an exemplary configuration of a fuser unit according to one embodiment of the present invention.

FIG. 2 is a schematic diagram showing an exemplary fixing device 100 according to one embodiment. Specifically, as shown there, the fixing device 100 includes a fixing belt 121 as a fixing member of a hollow endless rotary body, a pressing roller 122 as a pressing member composed of an opposed rotation member rotatably facing the fixing belt 121, and a halogen heater 123 serving as a heat source heating the fixing belt 121. The fixing device 100 further includes a pressing roller 122 disposed opposite through the fixing belt 121, a nip formation member 124 to form a nip N, a stay 125 as a support member to support the nip formation member 124, and a reflection member 126 to reflect light emitted from the halogen heater 123 to the fixing belt 121. The fixing device 100 further includes a temperature sensor 127 as a temperature detection device for detecting temperature of the fixing belt 121, a separation member 128 as a recording medium separation device to separate a sheet P from the fixing belt 121, and a bias device, not shown, to bias the pressing roller 122 to press against the fixing belt 121. The fixing device 100 further includes a thermistor as a temperature detection device for detecting temperature of the pressing roller 122 and a guide plate 135 to guide the sheet P to the nip section N.

The fixing belt 121 is directly heated by radiant heat emitted from the halogen heater 123 on an inner circumferential side thereof. The nip formation member 124 is provided inside the inner circumferential side of the fixing belt 121 (i.e., inside the fixing belt 121). The nip formation member 124 is deployed to directly slide on the inner surface of the fixing belt 121 or indirectly slide thereon through a sliding sheet, not shown.

Although the above-described exemplary nip N of FIG. 2 is flat, a concave or another shape can be employed. Because a discharge direction of a tip of the sheet P inclines to the pressing roller 122, and accordingly separation performance is improved when the shape of the above-described nip N is concave, an occurrence of jamming can be suppressed.

The fixing belt 121 mainly consists of a flexible belt with a thin wall (including a film). Specifically, the fixing belt 121 includes a substrate on the inner circumferential side, which is made of plastic material, such as polyimide (PI), etc., or metal, such as nickel, stainless steel (SUS), etc., and a releasing layer on the outer circumferential side, which is made of tetrafluoroethylene-par fluoroalkyl vinyl ether copolymer (PFA) or polytetrafluoroethylene (PTFE) and the like. The releasing layer has releasing performance so that toner does not adhere thereto. Further, an elastic layer made of rubber, such as silicone rubber, foam silicone rubber, fluorocarbon rubber, etc., may intervene between the base member and the releasing layer. When the elastic layer, such as silicone rubber layer, etc., is present while an unfixed image is crushed to be fixed, fine unevenness on the surface of the belt is hardly transferred onto an image and unevenness of gloss in an orange peel state (e.g., an orange peel image) rarely remains in the solid image. To further effectively prevent such skin-like glossy irregularity, the silicone rubber preferably has a given thickness, for example 100 [μm] or more. As the silicone layer deforms, the fine unevenness on the surface of the belt is absorbed, thereby ameliorating the orange peel image.

The pressing roller 122 has a core metal 122*a*, an elastic layer 122*b* made of rubber, such as foam silicone rubber, silicone rubber, fpm, etc., overlying the core metal 122, and a releasing layer 122*c* mainly consisting of PTFE or PFA and the like overlying the elastic layer 122*b*. The pressing roller 122 is pressed against the fixing belt 121 by the biasing device, such as a spring, etc., not shown, and engages the nip formation member 124 through the fixing belt 121. In a section where the fixing belt 121 contacts the pressing roller 122 under pressure, the elastic layer 122*b* of the pressing roller 122 is crushed so that a nip section N with a given width is formed.

The pressing roller 122 is provided with driving force from a driving source, such as a motor, etc., not shown, through a gear provided in a body of the image forming apparatus 1000 and is thereby driven and rotates. When the pressing roller 122 is driven and rotates, the driving force is transmitted to the fixing belt 121 at the nip section N, thereby driving and rotating the fixing belt 121.

The fixing belt 121 is driven and rotated by the pressing roller 122. Specifically, in the exemplary configuration of FIG. 2, the pressing roller 122 is driven by a driving source, such as motor, etc., not shown, so that driving force is transmitted to the fixing belt 121 at the nip section N. The fixing belt 121 is then pinched into the nip section N and is driven and travels with its widthwise opposed ends being guided by the later described belt holding member 140 at other portion than the nip section N.

Further, in this embodiment, since the pressing roller 122 is hollow, a heat source, such as a heater, etc., can be disposed inside the pressing roller 122. However, the pressing roller 122 can be a solid roller.

Further, in the absence of the elastic layer 122*b*, heat capacity decreases improving fixative. However, when an unfixed toner is crushed to be fixed, an unevenness of the belt surface is transferred onto an image, and gloss irregularity may occur in the solid section of the image. To prevent such a problem, an elastic layer 122*b* having a thickness of about 100 μm or more is preferably disposed. Since the small bumps can be absorbed by elastic deformation of the elastic layer 122*b* having a thickness of about 100 μm or more, occurrence of the uneven gloss can be evaded.

The elastic layer 122*b* of the pressing roller 122 may be made of solid rubber. However, the elastic layer 122*b* can be made of high insulation rubber, such as sponge rubber, etc., if a heat source is excluded from an inside of the pressing roller 122. Since heat is hardly deprived from the Fixing belt 121, usage of the high heat insulation rubber, such as sponge, etc. is more desirable. The fixing member, such as the fixing belt 121, etc., composed of the above-described heat rotation member and the pressing member formed from the opposed rotating member, such as the pressing roller 122, etc., are not necessarily pressed against each other, and can simply engage each other under no pressure.

Further, in the fixing device 100 of FIG. 2, the fixing belt 121 accommodates two halogen heaters 123 as the heat sources that provides different heat generation regions inside the fixing belt 121 and directly heats the belt 121 by emitting heater light (i.e., radiant heat). By differentiating the heating region of every halogen heaters 123, the fixing heating belt 121 can be heated corresponding to various widths of a sheet.

As one example, a device specified to give a priority to a sheet size of LT series is described herein below. Specifically, the halogen heater 123A as one of the two halogen heaters heats a sheet passage region of a widthwise center on the fixing belt 121 corresponding to a sheet P having a smaller width than an LTT size (i.e., a longitudinal letter size), and the other halogen heater 123B heats the sheet passage region of both ends on the A3T size (i.e., a A3 longitudinal size) wider than the LTT size. Both ends of each of the halogen heaters 123A and 123B are fixed to side plates (not shown) of the fixing device 100, respectively.

Further, when printing a sheet smaller than the LTT size, the halogen heater 123B is not illuminated but only the halogen heater 123A. When the sheet P of the A3T size (i.e., A3 size vertical) is printed, these halogen heaters 123A and 123B are lightened. Herein below, although printing onto a sheet P having the LTT size is typically described, a smaller size sheet P than the LTT size is similarly printed.

The halogen heaters 123A and 123B are controlled by a power source installed in the body of the image forming apparatus 1000 to generate heat as outputs. The output control may be executed by turning on/off and controlling an amount of power supplied to the halogen heaters 123A and 123B based on surface temperature of the fixing belt 121 detected by a temperature sensor 127. Hence, temperature of the fixing belt 121 can be adjusted to a desired level by controlling the outputs of the halogen heaters 123A and 123B.

Further, as a heat source heating the fixing belt 121, an IH (induction heating) heater, a resistance heater, a ceramic heater, or a carbon heater may be used beside the halogen heater.

The nip formation member 124 includes a base pad 131 and a sliding sheet (e.g. a low friction sheet) 130 on a surface of the base pad 131. The base pad 131 longitudinally extends in an axial direction of either the fixing belt 121 or the pressing roller 122 and determines a shape of the nip section N while receiving pressure from the pressing roller 122.

Further, the base pad 131 of the nip formation member 124 is fixed by the stay 125. Hence, deflection of the nip formation member 124 caused by pressure of the pressing roller 122 is substantially prevented, thereby obtaining a constant nip width in a direction of an axis of the pressing roller 122.

The base pad 131 of the nip formation member 124 mainly consists of a heat resistance member having heat-resistant temperature of more than 200 Degree Celsius. With this, deformation of the nip formation member 124 possibly caused by heat of toner fixing temperature can be substantially prevented stabilizing a nip formation condition and accordingly quality of an output image. As the base pad 131, general heat-resistant resin, such as polyethersulphone (PES), polyphenylene sulfide (PPS), liquid crystal polymer (LCP), polyether nitrile (PEN), polyamide imide (PAT), polyether ether ketone (PEEK), etc., can be employed.

The sliding sheet 130 is preferable if it is at least disposed on a surface of the base pad 131 facing the fixing belt 121. Hence, when the fixing belt 121 circulates sliding on the sliding sheet 130, driving torque and friction load caused thereon are reduced. However, the sliding sheet 130 can be omitted.

To exert a function of preventing deflection of the nip formation member 124, the stay 125 is desirably made of metal having high mechanical strength, such as stainless steel, iron, etc. Further, the base pad 131 is also desirably made of material having some degree of hardness to ensure strength. As material of the base pad 131, resin, such as liquid crystal polymer (LCP), etc., metal, and ceramic can be employed.

The reflection member 126 is disposed between the stay 125 and halogen heater 123 and is secured to the stay 125 in this embodiment. As material of the reflection member 126, aluminum and stainless steel or the like are employed. With the reflection member 126 arranged in this way, light (i.e., Heat radiation) emitted from the halogen heater 123 to the side of the stay 125 is reflected toward the fixing belt 121. Hence, intensity of incident light to the fixing belt 121 can be increased thereby efficiently heating the fixing belt 121. Further, since transmission of radiant heat from the halogen heater 123 to the stay 125 or the like can be suppressed, wasteful consumption of energy, i.e., heating of the stay 125 by the radiant heat from the halogen heater 123 can be suppressed saving the energy. The similar effect can be obtained if a mirror finishing or heat insulation process is applied to a surface of the stay 125 or the like instead of using the reflection member 126.

Further, various ideas are implemented in this embodiment of the fixing device 100 to further save energy and shorten a first printing time or the like. Specifically, the halogen heater 123 is configured to directly heat a portion of the fixing belt 121 other than the nip section N (i.e., a direct heating system). Further, any device is not disposed between a left side portion of the fixing belt 121 and the halogen heater 123 as shown in FIG. 2, so that radiant heat is directly provided from the halogen heater 123 to the fixing belt 121 at that section.

Further, to decrease heat capacity of it, the fixing belt 121 is thinned having a smaller diameter at substantially the same time. Specifically, a thickness of each of the substrate, elastic layer, and releasing layer collectively constituting the fixing belt 121 is set to a range of from about 20 μm to about 50 μm, from about 100 μm to about 300 μm, and from about 10 μm to about 50 μm, respectively, so that the total of those is 1 mm or less. Further, the diameter of the fixing belt 121 is set to about 20 mm to about 40 mm. To further decrease heat capacity, the total thickness of the fixing belt 121 is desirably set to about 0.2 mm or less, and is yet more desirably set to about 0.16 mm or less. Further, the diameter of the fixing belt 121 is desirably set to about 30 mm or less for substantially the same purpose.

In addition, in this embodiment, a diameter of the pressing roller 12 is set to from about 20 mm to about 40 mm so that diameters of the fixing belt 121 and the pressing roller 122 are substantially the same with each other. However, the present invention is not necessarily limited to the above-described configuration, and for example, the diameter of the fixing belt 121 may be smaller than that of the pressing roller 122. In that situation, since a curvature of the fixing belt 121 is smaller than that of the pressing roller 122 in the nip section N, a sheet P discharged from the nip section N becomes easily isolated from the fixing belt 121.

Further, as a result of minimizing the diameter of the fixing belt 121 as described above, an inner region thereof decreases. However, since both ends of the stay 125 are bent in a concave state and the halogen heater 123 is accommodated inside the concave, the stay 125 and the heater 123 can be arranged even in such a narrow region.

Further, in the fixing device 100 of FIG. 2, the nip formation section 124 is made compact instead so that the stay 125 can be disposed as wide as possible even in the narrow region 125. Specifically, a width of the base pad 131 in the sheet transport direction is smaller than the width of the stay 125 in substantially the same direction. Further, as shown in FIG. 2, when heights of the nip formation member 124 at downstream and upstream ends of the nip sections N in the sheet transport direction or those at a virtual extension line E are supposed to be h1 and h2, respectively, and the maximum height of the nip formation member 124 at a portion other than the downstream and upstream ends or that at the virtual extension line E is supposed to be h3, the below listed formulas are satisfied:

$$h1 \leq h3 \text{ and } h2 \leq h3.$$

With this arrangement, since both downstream and upstream ends of the nip formation section 124 do not intervene between the bending sections disposed upstream and downstream of the stay 125, the bending sections can be disposed close to the inner circumferential surface of the fixing belt 121. Consequently, the stay 125 can be arranged as wide as possible even in a limited space inside the fixing belt 121, so that strength of the stay 125 can be ensured. As a result, deflection of the nip formation member 124 possibly caused by the pressing roller 122 can be suppressed improving fixing performance.

Figure 3A:
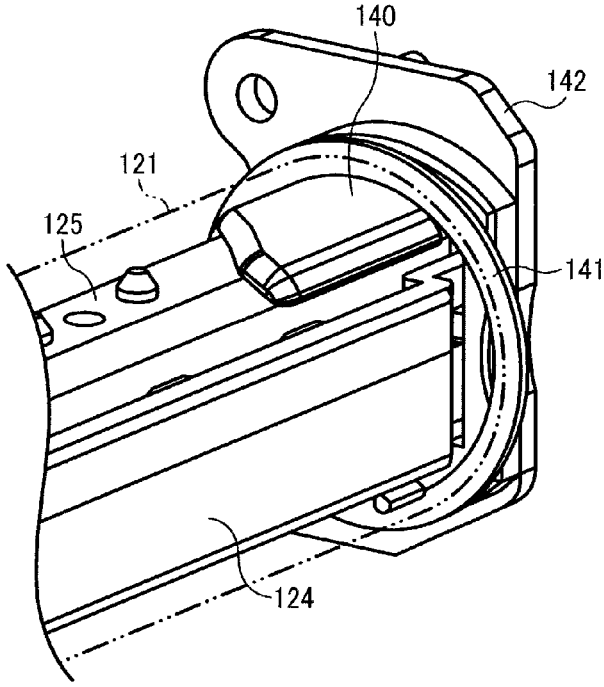
FIGS. 3A, 3B, and 3C are perspective, plan, and side views, respectively, collectively showing a configuration of one end of a fixing belt.
Figure 3B:
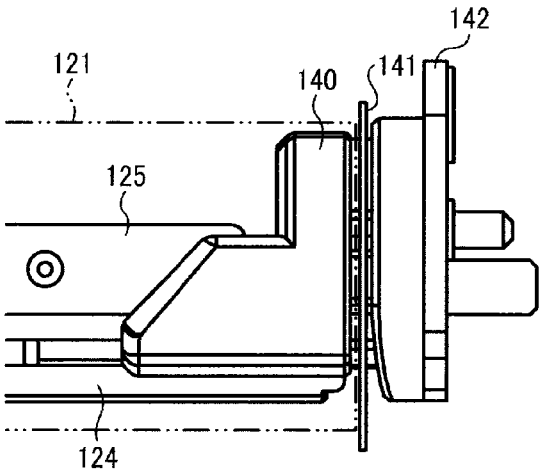
Figure 3C:
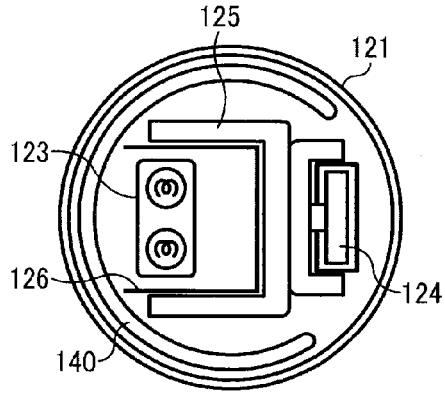

FIG. 3 is a diagram showing a configuration of one side end of the fixing belt 121. FIGS. 3A, 3B, and 3C are perspective, plan, and side views, respectively, collectively showing the configuration of one side end of the fixing belt 121. Although FIGS. 3A to 3C only illustrate the configuration of one side end of the fixing belt 121, since an opposite side end thereof has substantially the same configuration, only one side end is hereafter described with reference to FIG. 3.

As shown in FIGS. 3A or 3B, the belt holding member 140 is inserted into the one side end of (the fixing belt 121) in an (axial) direction perpendicular to a moving direction of the fixing belt 121 to rotatably hold the one side end of the fixing belt 121. Further, as shown in FIG. 3C, the belt holding member 140 has a shape, such as for example a flange, etc., with a C-shaped opening at the nip section N (i.e., a position in which the nip formation member 124 is disposed). Further, the belt holding member 140 is secured to the side plate 142. The side end of the stay 125 in its longitudinal direction is also fixed to and positioned at the side plate 142. Like the stay 125, the side plate 142 is made of metal, such as stainless steel, iron, etc. By using the substantially same material for the side plate 142 as the stay 125, installation accuracy can be easily obtained.

Further, as shown in FIG. 3A or FIG. 3B, there is provided a slip ring 141 between an end surface of the belt holding member 140 and an opposed surface of the fixing belt 121 to protect an edge of the fixing belt 121 as a protective member. Hence, even when the fixing belt 121 inclines in its axial direction, the edge of the fixing belt 121 does not directly contact the belt holding member 140, so that damage or wear of the edge of the fixing belt 121 can be substantially prevented. The slip ring 141 roughly attached to an outer circumference of the belt holding member 140 with a margin. Thus, even if the slip ring is designed to be driven by the fixing belt 121 when contacting the edge of the fixing belt 121, the slip ring 141 is not necessarily driven and can stop rotating. As material of the slip-ring 141, excellent heat-resistant material, such as so-called super engineering plastics (e.g., PEEK, PPS, PAI, and PTFE), etc., is preferably employed.

Figure 4A:
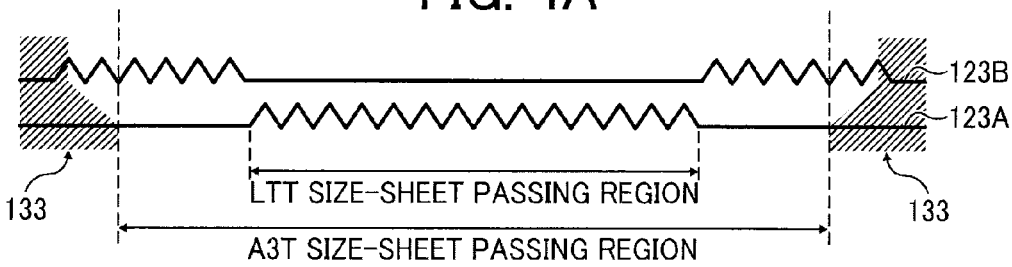
FIGS. 4A and 4B are diagrams respectively showing two types of shielding plates shielding the fixing belt from radiant heat emitted from a halogen heater.
Figure 4B:
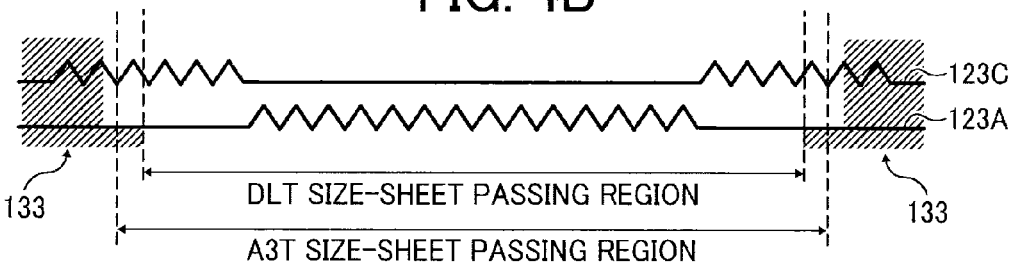

Further, as shown in the FIGS. 4A and 4B, a shielding plate 133 is provided at each of edges of the fixing belt 121 in its axial direction between the fixing belt 121 and the halogen heater 123 to block radiant heat from the halogen heater 123. Hence, excessive temperature rise in a non-sheet passage area on the fixing belt 121 may be suppressed especially when sheets p are continuously fed, thereby preventing damage or deterioration of the fixing belt 121 due to heat.

Referring now to the FIG. 2, an exemplary basic operation of the fixing device 100 according to this embodiment is described.

When a power switch is turned on in the image forming apparatus 1000, the halogen heater 123 is empowered and the pressing roller 122 starts rotation-driving clockwise in FIG. 2. Hence, the fixing belt 121 is driven and rotated counterclockwise as shown there by a friction caused by the pressing roller 122 contacting thereto.

A sheet P bearing an unfixed toner image T formed in the above-described the image formation process is guided by a guide plate, not shown, and transported in a direction as shown by arrow A1 in FIG. 2, and is further conveyed into the nip section N formed between the pressing roller 122 and the fixing belt 121 contacting thereto under pressure. The toner image T is fused onto the surface of the sheet P by the pressure between the fixing belt 121 and the pressing roller 122 and heat of the fixing belt 121 heated by the halogen heater 123.

The sheet P with the fixed toner image T is carried out from the nip section N in a direction as shown by arrow A2 in FIG. 2. At this moment, the tip of the sheet P contacts a tip of an isolation member 128, and the sheet P accordingly isolates from the fixing belt 121. The thus isolated sheet P is exhausted outside by the exit roller 7 as described above, and is stocked on the sheet exit tray 17.

Figure 5:
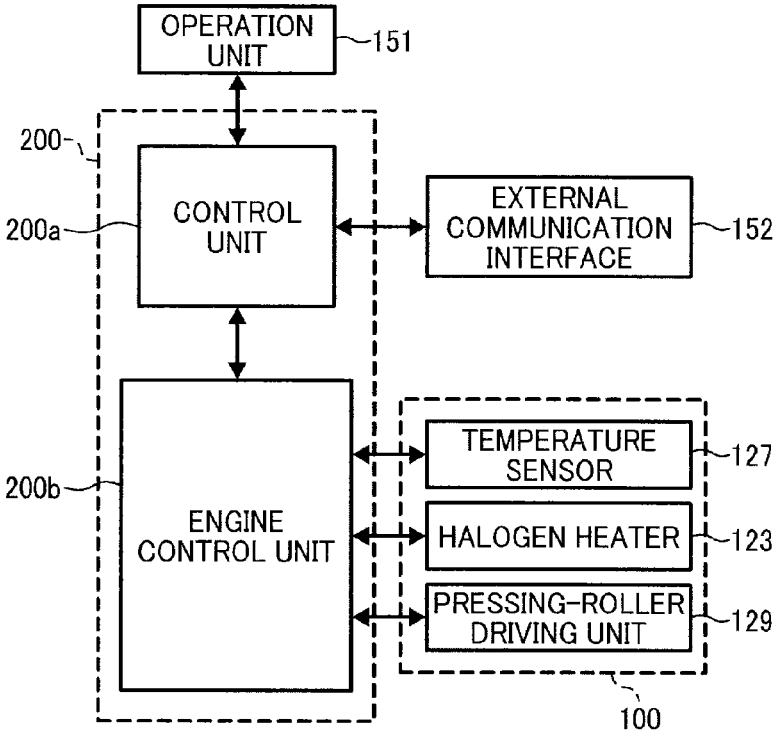
FIG. 5 is a block diagram showing one example of an essential part of a control system that controls the fixing device according to one embodiment of the present invention.

Now, a manner of controlling the fixing device 100 provided in the image forming apparatus 100 with the above-described configuration is described. FIG. 5 shows a block diagram showing one example of an essential part of a control system to control the fixing device 100 according to one embodiment. A control unit 200 as a control device has a controller 200*a* and an engine controller 200*b*.

The controller 200*a* has a CPU, a ROM, and a RAM or the like and is connected to an engine control unit 200*b*, an external communication interface unit 152, and an operation unit 151 or the like. The controller 200*a* generally controls the image formation apparatus 1000 and inputting from an external communication interface unit 152 and the operation unit 151 or the like by implementing certain preinstalled control programs. For example, the controller unit 200 accepts instructions entered and inputted through the operation unit 151 by a user, and performs various processing operations according to the inputted instruction. The controller unit 200*a* also receives image data or instruction of a printing job (i.e., an image formation job) from an external host computer system or the like via the external communication device 152. The controller 200*a* controls the image formation operation by controlling the engine control unit 200*b* to form color or black-and-white images on a sheet.

The engine control unit 200*b* has a CPU, a RAM, and a ROM or the like controls a printer engine (i.e., a multiple image forming unit, an optical write unit 8, and a fixing device 100) for executing an image formation process based on a direction given from the control unit 200*a* by implementing certain preinstalled control programs. For example, the engine control unit 200*b* controls power source to the halogen heater 123 so that temperature of the fixing belt 121 detected by the temperature sensor 127 becomes a given target level, while controlling the pressing roller-driving section 129 that drives and rotates the pressing roller 122 in an image forming operation mode.

This embodiment of the image forming apparatus 1000 has three modes of an image formation mode, a standby mode, and a sleep mode. The image formation mode represents a mode in which the image forming apparatus 1000 performs image formation processing. The standby mode represents a mode in which the image formation device 1000 waits for an instruction of running the image formation process. The sleep mode represents a mode consuming lower power than the standby mode. A fixing operation occurs in the fixing device 100 when a warmed up operation to increase temperature of the fixing belt 121 to a given fixing target level (for example, 158 to 170 degree Celsius) has been executed in the image formation mode. In the standby mode, temperature of the fixing belt 121 of the fixing device 100 is maintained to be lower than the fixing target temperature in the above-described image formation mode (for example, 90 degree Celsius) whereas in the sleep mode, power source to the printer engine and the engine control unit 200*b* of the fixing apparatus 100 or the like is cut off, so that the halogen heater 123 and the pressing roller 122 cannot be empowered and is impossible to rotate, respectively.

Figure 6:
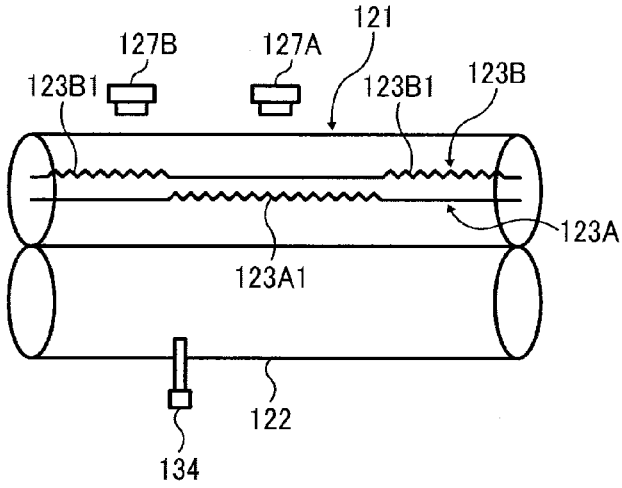
FIG. 6 conceptually illustrates the halogen heater, a temperature sensor, and a thermistor provided in the fuser unit.

Now, a feature of this embodiment is herein below described in more detail. As shown in FIG. 6, a heating section is different between the halogen heaters 123A and 123B.

Specifically, the halogen heater 123A has a heat-generating section (e.g., a light generating section) 123A1 almost at a center of a sheet width while extending over a given range. Specifically, in this embodiment, the heat generation section 123A1 symmetrically ranges from a widthwise center of the heater 123A to a position distanced therefrom about 200 mm to about 220 mm.

Whereas, the halogen heater 123B has heat-generating sections (light-generating sections) 123B1 at both ends of the sheet width, respectively. Specifically, in this embodiment, the heat generation sections 123B1 symmetrically range regarding a center of the halogen heater 123B in a widthwise direction of a sheet being distanced from the center by about 200 mm to 220 mm to about 300 mm to 330 mm toward left and right sides.

A sheet passage width is 297 mm when the A3T size sheet P (i.e., A3 (JIS)-vertical) or the A4Y size sheet P (A4(JIS)-lateral) is printed. However, the total length of the heat generation section 123B1 located at both ends of the halogen heater 123B and the heat generation section 123A1 located at the center of the halogen heater 123A is about 300 mm to about 330 mm and is thus longer than the above-described sheet passage width. That is, a heat generation amount (i.e., calorie) decreases (i.e., a luminous intensity is weaker) at the outer end of the heat generation section 123B1, and temperature drops there. However, a portion of the fixing belt 121 used as a sheet passage region needs to be able to generate a prescribed calorific value (i.e., heat strength).

A T-size (i.e., a vertical size) represents that a sheet P is conveyed and receives printing thereon with its longer side being in parallel to a sheet transport direction. A Y-size (i.e., a lateral size) represents that a sheet P is conveyed and receives printing with its shorter side being in parallel to the sheet transport direction.

In this embodiment, as a temperature detection device for detecting temperature of the fixing belt 121, a pair of non-contact temperature sensors 127 is provided being opposed to a circumferential surface of the fixing belt 121. Specifically, in FIG. 6, a temperature sensor 127A is provided corresponding to the heating section 123A1 of the halogen heater 123A to detect temperature of the fixing belt 121 at a widthwise center of a sheet P. Whereas a temperature sensor 127B is provided corresponding to the heat section 123B1 of the halogen heater 123B to detect temperature of the fixing belt 121 at a widthwise side end.

Figure 7:
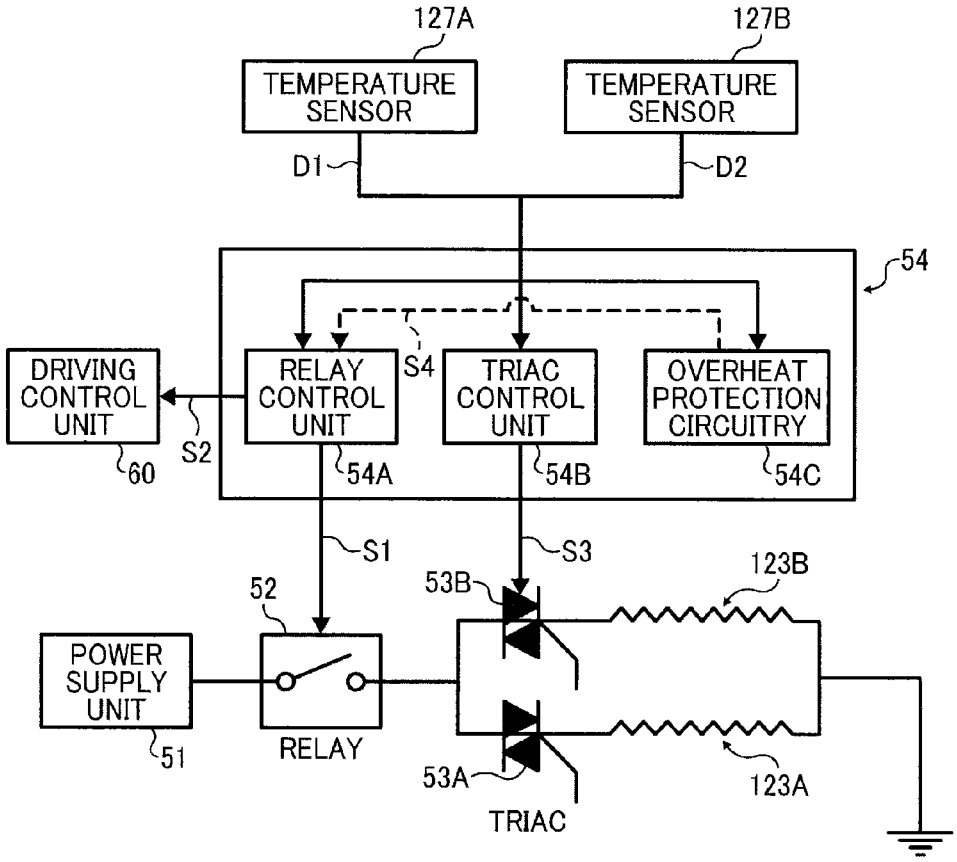
FIG. 7 illustrates a temperature control circuitry provided in the fixing device.

FIG. 7 illustrates an exemplary temperature control circuitry of the fixing device 100. Power supplied from the power source 51 is further supplied to the halogen heaters 123A and 123B respectively via the relay 52, triode alternating current switches 53A and 53B. The relay 52 is turned on (i.e., closed) during a print job running time period, a warming up time period, and a ready standby time period or the like. Otherwise, the relay 52 is turned off (i.e., open) during a power off time period, an off mode time period, a prompt halt time period, and an energy saving mode or the like. The triode alternating current switches 53A and 53B control an amount of electric power supplied to the halogen heaters 123A and 123B to maintain temperature of the fixing belt 121 at a prescribed level while feeding back temperature information of the fixing belt 121 detected by the temperature sensors 127A and 127B.

The temperature control unit 54 includes a relay controller section 54A that controls the relay 52 and the triode alternating current switch control section 54B that controls triode alternating current switches 53A and 53B, and an overheat protection circuitry 54C that outputs an emergency stop signal when the fixing belt 121 is overheated.

Temperature information data acquired by the temperature sensors 127A and 127B from the central and widthwise end regions of the fixing belt 121 in the widthwise direction, respectively, are inputted to the temperature control unit 54 as temperature information values (voltage values) D1 and D2.

In this embodiment, the relay control unit 54A is configured to output an ON/OFF control signal S1 and a drive control signal S2 to the relay 52 and the driving control section 60 for the pressing roller 122 based on the temperature information values D1 and D2, respectively. The triode alternating current switch control section 54B is configured to output a power source control signal S3 to the triode alternating current switch 53A based on the temperature information values D1 and D2. The overheat protection circuitry 54C is also configured to output an abnormal stop signal S4 to the relay control section 54A based on the temperature information values D1 and D2.

However, the temperature control section 54 is not limited to such a configuration. Specifically, the triode alternating current switch control section 54B can be configured to output a power source control signal S3 to the relay 52 as well, while the overheat protection circuitry 54C can be configured to directly output the abnormal stop signal S4 to the relay 52 and the driving control section 60.

Further, the overheat protection circuitry 54C can output the abnormal stop signal S4 upon overheat of the pressing roller 122 in addition to that of the fixing belt 121. In such a situation, a temperature detection signal generated by the thermistor 134 by detecting temperature of the pressing roller 122 is further provided to the overheat protection circuitry 54C.

The relay control section 54A maintains the relay 52 to be a turn off state when (the relay 52 is turned off and) power source to the halogen heaters 123A and 123B from the power source unit 51 is cut off, accordingly the fixing belt 121 and the pressing roller 122 stop rotating, and a given external operation is executed while at least one of temperature information values D1 and D2 sent from the temperature sensors 127A and 127B is the first reference value R1 or more (i.e., D1≥R1 or/and D2≥R1). Whereas, the relay control section 54A outputs an ON/OFF control signal S1 and turns the relay 52 on so that the power source 51 can supply power to the halogen heaters 123A and 123B when both the temperature information values D1 and D2 sent from the temperature sensors 127A and 127B become the second reference value R2 (i.e., D1≤R2 and D2≤R2) lower than the first reference value R1 or less.

The above-described stop rotating condition contains a stopping state of an image forming apparatus 1000 due to deactivation of the power source supplying power thereto, an off mode or an energy-saving mode of the fixing device 100, and a quick stopping state of the image forming apparatus 1000 due to sheet jamming or other reasons. Further, the above-described given external operations include turning on the power and restarting the image forming apparatus 1000, operation to instruct image formation (e.g., a print job) of the image forming apparatus 1000, and operation to return from a urgent stopping state in the image forming apparatus 1000.

In this embodiment, temperature information values D1 and D2 of voltages inputted from the temperature sensors 127A and 127B are utilized as are in the relay control section 54A without being converted. Specifically, the temperature information values D1 and D2 are then compared with the first and second reference values R1 and R2 as voltages corresponding to reference temperature levels enabling the above-described processing. Hence, processing in the relay control section 54A is speeded up and simplified.

However, the present invention is not limited to such a configuration, and the temperature information values D1 and D2 inputted from the temperature sensors 127A and 127B are subjected to a prescribed conversion process and are compared with the reference values R1 and R2 to enable the relay control section 54A to control base thereon.

Further, in this embodiment, when the above-described relation (D1≥R1 or/and D2≥R1) is established, the relay control section 54A maintains a turning off state of the relay 52 but outputs a driving control signal S2 to the driving control section 60 at substantially the same time, thereby causing the fixing belt 121 and the pressing roller 122 to circulate and rotate providing idling circulation and rotation, respectively. Hence, by spreading local overheat of the fixing belt 121, a time period until power becomes ready to be supplied (D1≤R2 and D2≤R2) to the halogen heaters 123A and 123B from the power section 51 can be shortened.

When causing the fixing belt 121 and the pressing roller 122 to provide the idling circulation and rotation, pressure between the fixing belt 121 and the pressing roller 122 is preferably adjusted to be substantially the same as that applied to a sheet P by the fixing belt 121 and the pressing roller 122 when it passes through the nip section N. Hence, the local overheating of the fixing belt 121 can disperse yet more quickly.

Herein below, an actually control manner controlling a printing process is more specifically described. Power available to the fixing device 100 is limited depending on a power consumption state of the other devices so that the total consumption power available to the image formation apparatus can fall within a prescribed level. For example, when color printing is executed optionally using a scanner, not shown, and a finisher, power is controlled by turning on the halogen heater 123 up to a lighting ratio of about 87% at most, which is a percentage of turning on the halogen heater per given time period.

Here, heat is deprived by the sheet P contacting the sheet passage region of the fixing belt 121 therefrom when the sheet P passes therethrough. Accordingly, when the sheets P are continuously fed, unless a halogen heater 123 provided corresponding to a size of the sheet P is not supplied with enough electricity to be able to heat the sheet passage region of the fixing belt 121 to a prescribed level of fusing temperature capable of keeping a proper fixing condition, the fusing temperature cannot maintained in the sheet passage region on the fixing belt 121 and causes defective fixing.

In particular, if productivity of the LTT size sheet P is higher than that of the A3T sheet P, a time interval between former and subsequent LTT size sheets P passing through the fixing device 100 is shorter than that between former and subsequent A3T size sheets P passing therethrough. Thus, if power supplied to the halogen heater 123A is substantially the same both when the A3T and LTT size sheets P are printed, the sheet passage region of the fixing belt 121 is insufficiently heated by the halogen heater 123A when the LTT size sheets are printed. Consequently, temperature of the sheet passage region of the fixing belt 121 cannot be raised up to the fusing temperature nor keeps the fuser temperature, thereby causing a problem, such as defective fixing, etc., when the LTT size sheets are printed.

Thus, power supplied to the halogen heater 123A is controlled to increase based on a detecting result of the temperature sensor 127A to obtain the fuser temperature in the sheet passage region of the fixing belt 121 when the LTT size sheets are printed. However, there exists a limit on power available to the fixing device 100 as described earlier. Specifically, the maximum power available to the fixing device 100 may be reached before a prescribed sufficiently amount of power is supplied to the halogen heater 123A to be able to heat the sheet passage region of the fixing belt 121 up to the fuser temperature. In such a situation, power lacks and is not sufficiently supplied to the heater 123A, so that the halogen heater 123A can no longer heat the sheet passage region of the fixing belt 121 up to the fuser temperature.

Further, in the fixing device 100 shown in FIG. 2, heating regions on the fixing belt 121 are differentiated corresponding to the heaters 123A and 123B in the widthwise direction of a sheet P, so that a region on the fixing belt 121 corresponding to a width of a sheet P having the A3T size can be heated by the halogen heaters 123A and 123B when the sheet P of the A3T size is printed. Whereas, another region on the fixing belt 121 corresponding to a width of a sheet P having the LTT size can be heated only by the halogen heater 123A when the sheet P of the LTT size is printed. Thus, since the power is not supplied to the halogen heater 123B when the LTT size sheet is printed, power available to the fixing device 100 has more extra than when the A3T size sheet is printed.

In this way, since available power to the fixing device 100 increases when the LTT size sheet is printed, the power supplied to the halogen heater 123A is increased more than when the A3T size sheet is printed within the maximum power available to the fixing device 100 when the LTT size sheet is printed. Specifically, the power available to the fixing device 100 is supplied focusing on the halogen heater 123A when the LTT size sheet is printed without using the halogen heater 123B but only 123A more than when the A3T size sheet is printed using both the halogen heaters 123A and 123B.

For example, when the A3T size sheet is printed, a rate of lighting each of the halogen heaters 123A and 123B is limited to about 87%. By contrast, since the halogen heater 123B does not need to be lightened, and the power source can focus on the halogen heater 123A when the LTT size sheet is printed, the lighting ratio for the halogen heater 123A can be raised up to the maximum of 100%.

Thus, the power available to the fixing device 100 does not reach the maximum level therefor nor falls into a lack of power when the LTT size sheet is printed. As a result, occurrence of defective fixing can be suppressed by heating the fixing belt 121 and increasing temperature thereof up to the fusing level with the halogen heater 123A.

Figure 8:
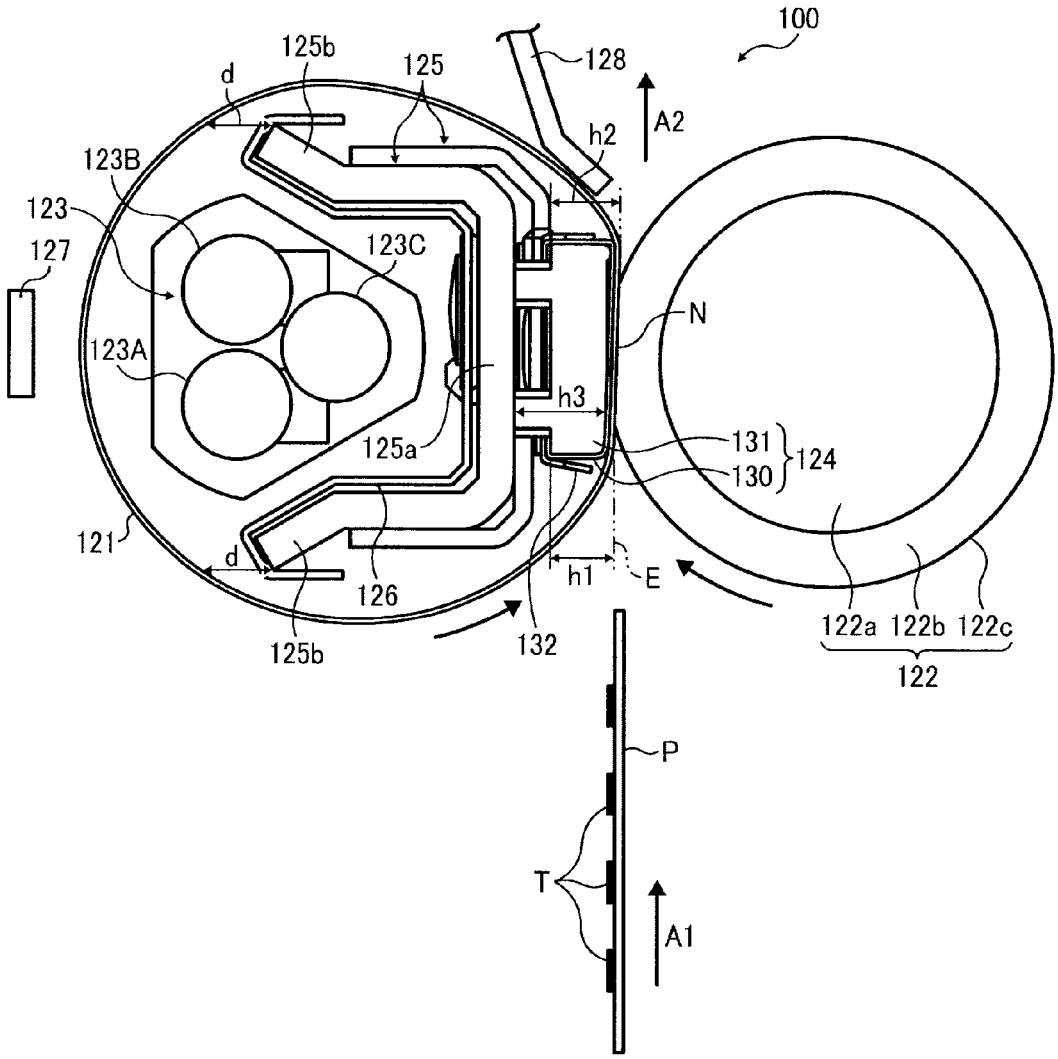
FIG. 8 is a schematic diagram showing another exemplary configuration of the fuser unit according to another embodiment of the present invention.

FIG. 8 is a schematic diagram showing an exemplary configuration of another fixing device 100 according to another embodiment of the present invention.

A fixing device 100 includes a fixing belt 121 as a fixing member mainly consisting of a rotatable heating member, a pressing roller 122 as a pressing member mainly consisting of an opposed rotating member rotatably opposed to the fixing belt 121, and a halogen heater 123 as a heat source for heating the fixing belt 121.

The fixing device 100 employs a system of directly heating the fixing belt 121 with heater light (i.e., radiant heat) emitted from the halogen heater 123, and includes three halogen heaters 123 as a heat source having different heat generation regions from each other inside the fixing belt 121. Specifically, by differentiating the heating regions of every halogen heaters 123, the fixing belt 121 can be heated corresponding to various sheet widths.

A device of this embodiment has a prescribed specification emphasizing LT series of a sheet size as typically described herein below. That is, the three halogen heaters 123 include, in a fixing belt 121 width-wise direction, a halogen heater 123A as a central heat source to heat a passage region of a sheet P having a smaller size than the LTT size, which corresponds to a central region in the widthwise direction of the fixing belt 121, a halogen heater 123B as a first end heat source for heating both ends of the sheet passage region of a DLT size sheet P (i.e., a double letter size sheet) having a greater width than the LTT size sheet, and a halogen heater 123C as a second end heat source to heat both ends of the sheet passage region of the A3T size sheet (A3 size-vertical) having a greater width than the DLT size sheet.

Further, when a sheet P of a smaller size than the LTT size is printed, none of the halogen heaters 123B and 123C is lightened but only the halogen heater 123A. To print a sheet P of the DLT size, both the halogen heaters 123A and 123B are turned on. To print a sheet P having the A3T size sheet P (i.e., A3-vertical), both the halogen heaters 123A and 123C are turned on.

Further, when printing a sheet P of a size smaller than the LTT size, none of the halogen heaters 123B and 123C is lightened but only the halogen heater 123A. To print a sheet P of the DLT size, both the halogen heaters 123A and 123B are turned on. Whereas, to print a sheet P of the A3T (i.e., A3-vertical), both the halogen heaters 123A and 123C are turned on. Herein below, although an operation executed when a sheet P of the LTT size is used is typically described, the same substantially goes when another sheet P of a size smaller than the LTT size is used.

In the fixing device 100 of FIG. 8, the halogen heaters 123A, 123B, and 123C serve as vertexes, respectively, and collectively form a triangle when viewed in a widthwise direction of the fixing belt 121. Specifically, the respective halogen heaters 123 are arranged in such a manner that the halogen heater 123C is disposed closer to the nip forming section 124, i.e., a rear side, than the other halogen heaters 123B and 123C. Hence, in a system specified by emphasizing the LT series of a sheet size (i.e., sizes of LTT and DLT or the like) as described earlier, when a sheet P of the DLT or LTT size (more commonly used than the A3T size) is printed, efficiency of heat transfer from the halogen heaters 123A and 123B to the fixing belt 121 can be prioritized.

Further, because a sheet width (i.e., a widthwise length perpendicular to a sheet transport direction) of the DLT size and that of a LTY (a sheet lateral size) are substantially the same with each other, the same substantially goes when a sheet P of the LTY size is used instead of the DLT size. Similarly, because a sheet width of A3T size and that of A4Y size are substantially the same, the same substantially goes when a sheet P of the A4Y size is used instead of the A3T size.

Further, a sheet metal 132 is provided to enclose the nip formation section 124 in the fixing device 100, so that the stay 125 can support the nip formation member 124 through the sheet metal 132.

Further, in the fixing device 100 of FIG. 8, to arrange the stay as wide as possible even in a small space 125, the nip formation member 124 is made compact conversely. Specifically, a width of the base pad 131 in the sheet transport direction is smaller than that of the stay 125 in the same direction. Further, as shown there, when heights of the respective upstream and downstream ends of the nip section N of the nip formation member 124 in the sheet transport direction, or a height of a virtual extension line E extended connecting these two ends are supposed to be h1 and h2, and a maximum height of the nip section N in the nip formation member 124 at a portion other than the downstream and upstream ends or a height of the virtual extension line E at the portion is supposed to be h3, the below described inequalities are established;

$$h1 \leq h2 \text{ and } h2 \leq h3.$$

With such arrangement, both the downstream and upstream ends of the nip formation member 124 do not intervene between the bends formed at the upstream and downstream ends of the stay 125 in the sheet transport direction and the fixing belt 121. Consequently, each bend of the stay 125 can be closely disposed to an inner circumferential surface of the fixing belt 121. Hence, the stay 125 can be provided in a limited space of the fixing belt 121 as large as possible ensuring its strength. As a result, deflection of the nip formation member 124 possibly caused by effect of the pressing roller 122 can be substantially avoided improving fixing performance.

To further ensure its strength in this embodiment, the stay 125 includes a base portion 125*a* extended in the sheet transport direction (i.e., a vertical direction in FIG. 8) contacting the nip formation member 124, and a pair of rising portions 125*b* rising from the respective upstream and downstream ends of the base section 125*a* in the sheet transport direction, respectively, extended toward fixing belt 121 (i.e., on the left side in FIG. 8). That is, with the rising portions 125*b* of the stay 125, a cross section of the stay 125 becomes laterally longer in a direction of pressure applied by the pressing roller 122 and increases its section modulus, thereby capable of upgrading its mechanical strength.

In this way, as the rising portions 125*b* of the stay 125 are formed longer in an abutting direction toward the fixing belt 121( ), strength of the stay 125 increases. Accordingly, a tip of the rising portion 125*b* is preferable if it is disposed as close as possible to the inner circumferential surface of the fixing belt 121. However, since it vibrates by some degree (disorder operation) during its rotation, the fixing belt 121 possibly contacts a tip of the rising portion 125*b* if the tip thereof is disposed excessively close to the inner circumferential surface of the fixing belt 121. In such a situation, since amplitude of vibration is relatively large especially in a system that uses a thin fixing belt 121 as in this embodiment, positioning of the tip of the rising portion 125*b* needs to pay a prescribed attention.

Specifically, a distance "d" between the tip of the rising portions 125*b* of the stay 125 and the inner circumferential surface of the fixing belt 121 in the abutment direction to the fixing belt 121 (pressing roller 122) is preferably 2.0 mm, and more preferably 3.0 mm or more in this embodiment. Further, the fixing belt 121 has a prescribed enough thickness and accordingly rarely vibrates, the above-described distance "d" can be set to about 0.2 mm. Further, when the reflection member 126 is attached to the tip of the rising portion 125*b* as in this embodiment, the above-described distance "d" needs to be determined not to cause the reflection member 126 to contact the fixing belt 121.

In this way, since it is disposed as close as possible to the inner circumferential surface of the fixing belt 121, the lengthy rising portion 125*b* can be disposed in the abutment direction of the fixing belt 121 (pressing roller 122). Hence, even in the system using the small-diameter fixing belt 121, mechanical strength of the stay 125 can be improved.

Here, in an exemplary configuration of FIG. 8, however, power available to the fixing 100 is limited depending on a power consumption state of the other device provided in the image forming apparatus 100 to suppress the total power consumption within a prescribed level.

Further, in the fixing device 100 of FIG. 8, the halogen heaters 123A, 123B, and 123C heat different regions in the sheet width-wise direction of the fixing belt 121, respectively, as shown there. Specifically, when a sheet P of DLT size is printed, a region of the fixing belt 121 corresponding to a width of the sheet P of DLT size can be heated by the halogen heaters 123A and 123B. Whereas, when a sheet P of A3T size is printed, a region of the fixing belt 121 corresponding to a width of the sheet P of A3 size can be heated by the halogen heaters 123A and 123C. Further, when a sheet P of LTT size is printed, a region of the fixing belt 121 corresponding to a width of the sheet P of LTT size can be heated only by the halogen heater 123A. Thus, since neither the halogen heater 123B nor the halogen heater 123C is supplied with power when a LTT size sheet is to be printed, power available to the fixing device 100 can have more margin than when the DLT size sheet or the A3T size sheet is printed.

Hence, since power available to the fixing device 100 increases to have the margin when the LTT size sheet is printed, more power can be supplied to the halogen heater 123A within the maximum power available to the fixing device 100 than when either the DLT size or A3T size sheet is printed. Specifically, when the LTT size sheet is printed only using the halogen heater 123A excluding the halogen heaters 123B and 123C, more power available to the fixing device 100 is supplied focusing on the halogen heater 123A than when the A3T or the DLT size sheet is printed.

That is, when the DLT size sheet is printed for example, a lighting rate of each of the halogen heaters 123A and 123B is limited to about 87%. Also, when the A3T size sheet is printed, the lighting ratio of each of the halogen heaters 123A and 123C is limited to about 87%.

By contrast, since none of the halogen heaters 123B and 123C need to be lightened when the LTT size sheet is printed, power can be supplied focusing on the halogen heater 123A, and accordingly the lighting ratio of the halogen heater 123A can be increased up to the maximum of 100%.

Hence, since power does not lack by reaching the upper limit available to the fixing device 100 when the LTT size sheet is printed, the fixing belt 121 is heated by the halogen heater 123A and its temperature is raised up to a fusing level while suppressing fixing defects.

The halogen heater 123B is designed to match the DLT size. However, when sheets are continuously printed using heater light with its luminous distribution as is, temperature of a non-sheet passage region on the fixing belt 121 excessively increases as a result. Therefore, to reduce radiant heat emitted from the halogen heater 123B and arriving at the non-sheet passage region, i.e., a region beyond a sheet width of the DLT size on the fixing belt 121, a shielding plate 133 is provided between the halogen heater 123B and the fixing belt 121 to shield (i.e., shade) the non- sheet passage region from the heater light emitted from the halogen heater 123B.

Similarly, the halogen heater 123C is designed to match the A3T size. However, to suppress excessive temperature increase in the non-sheet passage region on the fixing belt 121 and reduce the radiant heat emitted from the halogen heater 123C and arriving at the non-sheet passage region, i.e., a region beyond a sheet width of the A3T size on the fixing belt 121, the shielding plate 133 is also provided between the halogen heater 123C and the fixing belt 121 to shield the non-sheet passage region from the heater light emitted from the halogen heater 123C.

When the end portion of the halogen heater 123B corresponding to the non-sheet passage region is completely covered by the shielding plate 133, and the DLT size sheet P is printed, almost all of the heater light emitted from the halogen heater 123B to the above-described non-sheet passage region can be blocked.

However, when the above-described end portion of the halogen heater 123B is completely covered by the shielding plate 133 and the DLT size sheet P is printed, an end of a sheet passage region on the fixing belt 121 is also blocked by the shielding plate 133 from the halogen heater 123C. Consequently, the halogen heater 123C cannot sufficiently heat the end of the sheet passage region on the fixing belt 121, thereby generating fixing defect due to insufficient fixation temperature at the edge of the sheet passage region.

Accordingly, the shield plate 133 has a prescribed shape capable of reducing excessive temperature rising in the non-sheet passage region for each of the A3T and DLT sizes while suppressing the defective fixing at the edge of the A3T size sheet as shown in FIG. 4B. Specifically, a rectangular notch is formed on a portion of the shielding plate 133, in which the end of the sheet passage region of the A3T size sheet overlaps with the non-sheet passage region of the DLT size sheet in the widthwise direction.

Accordingly, in a range, in which the notch on the shielding plate 133 faces the halogen heater 123B in a fixing belt rotating direction, heater light emitted from the halogen heater 123B passes through the notch and heats the fixing belt 121. Whereas in a range, in which the shielding plate 133 is opposed to the halogen heater 123B in the fixing belt rotating direction, since heater light emitted from the halogen heater 123B is blocked by the shielding plate 133, the heater light emitted from the halogen heater 123B does not heat the fixing belt 121. Consequently, in the range in which the non-sheet passage region of the DLT size sheet P overlaps with the edge of the sheet passage region of the A3T size sheet P in the widthwise direction of the fixing belt 121, the heater light emitted from the halogen heater 123B is blocked by the shielding plate 133 with a prescribed percentage (e.g., about 20%), so that excessive temperature increase can be suppressed.

Further, in the range, in which the shielding plate 133 is opposed to the halogen heater 123C in the fixing belt rotating direction, since the heater light emitted from the halogen heater 123C is blocked by the shielding plate 133, the heater light emitted from the halogen heater 123C does not heat the fixing belt 121. Whereas in the range, in which the notch on the shielding plate 133 faces the halogen heater 123C in the fixing belt rotating direction, the heater light emitted from the halogen heater 123C passes through the notch and heats the fixing belt 121. Hence, since the edge of the sheet passage region of the A3T size sheet P on the fixing belt 121 can be heated by the heater light emitted from the halogen heater 123C passing through the notch, defective fixing possibly caused at both ends of the A3T size sheet P by lack of fusing temperature can be suppressed.

Accordingly, the fixing device 100 can suppress excessive temperature rising in the non-sheet passage region of each of sheet sizes (e.g., a DLT size or an A3T size) while reducing the defective fixing possibly caused on both edges of the A3T size sheet.

In a system specified by emphasizing a size of LT series like the fixing device 100 shown in FIG. 8, a shielding plate 133 is necessarily provided to shield a non-sheet passage region of a DLT size sheet P on the fixing belt 121 from heater light. However, when the A3T size sheet is printed, an edge of a sheet passage region of the A3T sheet P overlapping with the non-sheet passage region of the DLT size sheet P, in which the shielding plate 133 is located therefor, needs to be heated by heater light emitted from the halogen heater 123.

Further, the halogen heater 123C is located on the further back side in the inner circumference of the fixing belt 121 than the other halogen heaters 123A and 123B. In such a situation, when the A3T size sheet is printed, the halogen heaters 123A and 123C are used. However, heating efficiency of the halogen heater 123C heating the fixing belt 121 is slightly worse than the halogen heater 123A. Therefore, to heat the fixing belt 121 with the similar efficiency to the halogen heater 123A, the halogen heater 123C needs more power than the halogen heater 123A.

Then, in this embodiment, when the A3T size sheet P is printed, power source is controlled to allocate more power to the halogen heater 123C than the halogen eater 123A under the above-described power consumption limitation. Hence, defective fixing possibly occurring at an edge of the A3T size sheet in the widthwise direction can be reduced.

Further, the present invention can be applied to another image forming apparatus equipped with a fixing device using a different system, such as a fixing device in which an fixing belt is stretched by a heating roller and an fixing roller while a pressing roller is pressed against the fixing roller via the fixing belt, a surface fixing device that only locally heats a nip section with a ceramic heater, etc.

Further, the fixing device of this invention is not limited to the color laser printer of FIG. 1, and can be installed in a black and white image forming apparatus, a printer, a copier, a facsimile, and a multifunctional device or the like. Of course, various changes not deviating from the gist of the present invention can be possible.

According to the exemplary configuration of the fixing device 100 shown in FIGS. 2 and 8, the nip formation member 124 can guide the fixing belt 121 approaching to the nip N. Therefore, a traveling motion of the fixing belt 121 is controlled before entering the nip section N, so that entrance of the fixing belt 121 can be stable and smooth. Hence, by guiding the fixing belt 121 with the nip formation member 124, rotation of the fixing belt 121 can be stable and smooth even in a system not employing a particular guide other than the nip formation member 124 and the guides for both edges of the fixing belts 121. Hence, since a load and accordingly wear of the rotating fixing belt 121 is reduced, breakage or rupture thereof can be substantially suppressed upgrading credibility as a system. In particular, even in a system in which a fixing belt 121 is made thin to obtain low heat capacity, breakage or rupture thereof can be again substantially prevented.

Further, according to the fixing device 100 shown in FIGS. 2 and 8, since the fixing belt 121 is guided by the nip formation member 124, the system can be simplified and compact with a low-cost. Hence, since the fixing device 100 can obtain lower heat capacity, a warm up time and a first printing time can be shortened while efficiently saving energy.

In addition, since the nip formation member 124 exerts a guiding function omitting an additional guide, the system can omit any devices between the inner circumferential surface of the fixing belt 121 and upstream and downstream sections of the stay 125 in the sheet transport direction (i.e., these are directly opposed to each other). Hence, the largest possible stay 125 can be disposed closer to the inner circumferential surface of the fixing belt 121 at both ends in the sheet transport direction, and accordingly it is disposed in the limited space in the fixing belt 121. As a result, even in a system in which a diameter of the fixing belt 121 is small to obtain low heat capacity like the above-described fixing device 100, sufficient strength of the stay 125 can be ensured and possible deflection of the nip formation member 124 caused by the pressing roller 122 can be substantially avoided, thereby upgrading fixing performance.

Further, in the fixing device 100 shown in FIGS. 2 and 8, the nip formation member 124 can be installed away from the fixing belt 121 while the fixing belt 121 is not contacted by the pressing roller 122. As a result, the fixing belt 121 is enabled not to be strongly pressed against the nip formation member 124 both at the downstream and upstream ends of the nip section N in the sheet transport direction. Hence, wear and sliding load on the fixing belt 121 generally caused by contact of the nip formation member 124 can be suppressed. Further, since a contacting force of the fixing belt 121 against the nip formation member 124 is damped, an entrance path of the fixing belt 121 entering the nip section N can be optimized.

According to one embodiment of the fixing device, occurrence of defective fixing can be suppressed reducing power consumption in the entire unit when a small size sheet is printed. Because, the fixing device for conveying small and large size sheets includes a hollow endless rotary body, a pressing member to contact an outer circumferential surface of the endless rotary body, and a nip forming member placed on an inner circumferential side of the endless rotary body to contact the pressing member via the endless rotary body and form a nip thereon. A heating device is placed on the inner circumferential side of the endless rotary body to heat the endless rotary body with radiant heat. A power source is provided to supply power to the heating device. The heating device includes a first heat source to heat a region on the endless rotary body corresponding to a width of the small size sheet and a second heat source to heat regions on the endless rotary body corresponding to both widthwise ends of the large size sheet outside the width of the small size sheet. Further, the power source supplies power only to the first heat source when the small size sheet is printed and to both the first and second heat sources when the large size sheet is printed. Further, the power source supplies more power to the first heat source when the small size sheet is printed than when the large size sheet is printed within a maximum power available to the fixing device.

According to another embodiment of the fixing device, an appropriate fixing condition can be maintained by heating a sheet passage region on an endless rotary body up to a prescribed fusing temperature level with a first heat source. Because the power source supplies power to the first heat source with a lighting rate of 100% when the small size sheet is printed. The lighting rate is a percentage of lighting the heat source per unit time.

According to yet another embodiment of the fixing device, excessive temperature rising can be suppressed in a non-sheet passage region of the endless rotary body. Because, a first shielding member is provided to shield the endless rotary body from radiation heat emitted from the first and second heat sources, and the shielding member is arranged between the endless rotary body and both widthwise ends of the first and second heat sources. Further, the heating device further includes a third heat source to heat a region of the endless rotary body corresponding to both ends and outer sides of the large size sheet (in the widthwise direction), and a second shielding member is provided to shield the endless rotary body from radiation heat emitted from the second and third heat sources. The second shielding member is arranged between the endless rotary body and both widthwise end of the second and third heat sources.

According to yet another embodiment of the fixing device, efficient of heat transfer from a heat source to the endless rotary body is prioritized when a frequently used size paper is printed. Because, the respective first to third heat sources serve as vertexes collectively forming almost a triangle when viewed in a widthwise direction of the endless rotary body, and the third heat source is located closer to the nip formation member than the first and second heat sources.

According to yet another embodiment of the fixing device, occurrence of defective fixing at a widthwise edge of it can be suppressed when a sheet having a greater width than a larger size sheet is printed. Because, the power source device supplies power only to the first and third heat sources, and the power supplied to the third heat source is greater than that supplied to the first heat source when a sheet having a greater width than the large size sheet is printed.

According to yet another embodiment of the fixing device, occurrence of defective fixing can be suppressed while suppressing total power consumption in the fixing device when a small size sheet is printed. Because an image forming apparatus includes an image carrier, a latent image formation device to form a latent image on the image carrier, a developing device to form a toner image by developing the latent image with toner, a transfer device to transfer the toner image from the image carrier onto a sheet, and the above-described fixing device fixing the toner image transferred onto the sheet.

Numerous additional modifications and variations of the present invention are possible in light of the above teachings. It is therefore to be understood that within the scope of the appended claims, the present invention may be practiced otherwise than as specifically described herein.

What is claimed is:

1. A fixing device for conveying at least relatively small and large size sheets, the fixing device comprising:

a hollow endless rotary body;

a pressing member to contact an outer circumferential surface of the endless rotary body;

a nip forming member placed on an inner circumferential side of the endless rotary body to contact the pressing member via the endless rotary body and form a nip thereon;

a heating device placed on the inner circumferential side of the endless rotary body to heat the endless rotary body with radiant heat, the heating device including at least a first heat source to heat a region on the endless rotary body corresponding to a width of the small size sheet and a second heat source to heat regions on the endless rotary body corresponding to both widthwise ends of the large size sheet outside the width of the small size sheet;

a power source to supply power to the heating device; and a temperature controller to control the power source, the temperature controller causing the power source to supply power only to the first heat source when the small size sheet is printed, and to both the first and second heat sources when the large size sheet is printed, the temperature controller causing the power source to supply more power to the first heat source when the small size sheet is printed than when the large size sheet is printed within the maximum power available to the fixing device.

2. The fixing device as claimed in claim 1, wherein the power source supplies power to the first heat source with a lighting rate of 100% when the small size sheet is printed, the lighting rate being a percentage of lighting the heat source per unit time.

3. The fixing device as claimed in claim 1, further comprising a first shielding member to shield the endless rotary body from radiation heat emitted from the first and second heat sources, the shielding member being arranged between the endless rotary body and both widthwise ends of the first and second heat sources.

4. The fixing device as claimed in claim 1, wherein the heating device further includes a third heat source to heat a region of the endless rotary body corresponding to both ends and outer sides of the large size sheet in the widthwise direction, further comprising a second shielding member to shield the endless rotary body from radiation heat emitted from the second and third heat sources, the second shielding member being arranged between the endless rotary body and both widthwise ends of the second and third heat sources.

5. The fixing device as claimed in claim 4, wherein the respective first to third heat sources serve as vertexes collectively forming substantially a triangle in a widthwise direction of the endless rotary body, and wherein the third heat source is located closer to the nip formation member than the first and second heat sources.

6. The fixing device as claimed in claim 5, wherein the power source device supplies power only to the first and third heat sources, the power supplied to the third heat source being greater than that supplied to the first heat source when a sheet having a greater width than the large size sheet is printed.

7. An image forming apparatus comprising:

an image carrier;

a latent image formation device to form a latent image on the image carrier;

a developing device to form a toner image by developing the latent image with toner;

a transfer device to transfer the toner image from the image carrier onto a sheet; and the fixing device as claimed in claim 1, the fixing device fixing the toner image transferred onto the sheet.

8. The image forming apparatus as claimed in claim 7, wherein the power source supplies power to the first heat source with a lighting rate of 100% when the small size sheet is printed, the lighting rate being a percentage of lighting the heat source per unit time.

9. The image forming apparatus as claimed in claim 7, further comprising a first shielding member to shield the endless rotary body from radiation heat emitted from the first and second heat sources, the shielding member being arranged between the endless rotary body and both widthwise ends of the first and second heat sources.

10. The image forming apparatus as claimed in claim 9, wherein the heating device further includes a third heat source to heat a region of the endless rotary body corresponding to both ends and outer sides of the large size sheet in the widthwise direction, further comprising a second shielding member to shield the endless rotary body from radiation heat emitted from the second and third heat sources, the second shielding member being arranged between the endless rotary body and both widthwise ends of the second and third heat sources.

11. The image forming apparatus as claimed in claim 10, wherein the respective first to third heat sources serve as vertexes collectively forming substantially a triangle in a widthwise direction of the endless rotary body, and wherein the third heat source is located closer to the nip formation member than the first and second heat sources.

12. The image forming apparatus as claimed in claim 11, wherein the power source device supplies power only to the first and third heat sources, the power supplied to the third heat source being greater than that supplied to the first heat source when a sheet having a greater width than the large size sheet is printed.

13. A fixing device for conveying at least relatively small and large size sheets, the fixing device comprising:

endlessly rotating means;

means for pressing against an outer circumferential surface the endlessly rotating means;

nip forming means placed on an inner circumferential side of the endlessly rotating means for forming a nip on the endlessly rotating means by contacting the pressing means via the endlessly rotating means;

heating means placed on the inner circumferential side of the endless rotary body for heating the endlessly rotating means with radiant heat, the heating means including at least a first heat source to heat a region on the endlessly rotating means corresponding to a width of the small size sheet and a second heat source to heat regions on the endlessly rotating means corresponding to both widthwise ends of the large size sheet outside the width of the small size sheet; and means for supplying power to the heating means, wherein the power supplying means supply power only to the first heat source when the small size sheet is printed, and to both the first and second heat sources when the large size sheet is printed, the power supplying means supplying more power to the first heat source when the small size sheet is printed than when the large size sheet is printed within a maximum power available to the fixing device.

* * * * *